US009146524B2

(12) United States Patent
Gohda et al.

(10) Patent No.: US 9,146,524 B2
(45) Date of Patent: Sep. 29, 2015

(54) CLEANING BLADE, IMAGE FORMING APPARATUS, AND PROCESS CARTRIDGE

(71) Applicants: Shohei Gohda, Kanagawa (JP); Shinji Nohsho, Tokyo (JP); Masanobu Gondoh, Kanagawa (JP); Kaori Toyama, Kanagawa (JP); Yohta Sakon, Kanagawa (JP); Masahiro Ohmori, Kanagawa (JP)

(72) Inventors: Shohei Gohda, Kanagawa (JP); Shinji Nohsho, Tokyo (JP); Masanobu Gondoh, Kanagawa (JP); Kaori Toyama, Kanagawa (JP); Yohta Sakon, Kanagawa (JP); Masahiro Ohmori, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/323,018

(22) Filed: Jul. 3, 2014

(65) Prior Publication Data

US 2015/0023707 A1 Jan. 22, 2015

(30) Foreign Application Priority Data

Jul. 17, 2013 (JP) ..... 2013-148159

(51) Int. Cl.
*G03G 21/18* (2006.01)
*G03G 21/00* (2006.01)

(52) U.S. Cl.
CPC ..... *G03G 21/0017* (2013.01); *G03G 21/18* (2013.01)

(58) Field of Classification Search
CPC ..... G03G 21/0017; G03G 21/0011
USPC ..... 399/350
See application file for complete search history.

(56) References Cited

U.S. PATENT DOCUMENTS

2011/0135361 A1* 6/2011 Kabata et al. ..... 399/350
2014/0295337 A1* 10/2014 Iwadate et al. ..... 430/73

FOREIGN PATENT DOCUMENTS

JP 9-127846 5/1997
JP 2004-233818 8/2004

(Continued)

OTHER PUBLICATIONS

Xu et al. "Preparation, Tg Improvement, and Thermal Stability Enhancement Mechanism of Soluble Polymethyl Methacrylate Nanocomposites by Incorporating Octavinyl Polyhedral Oligomeric Silsesquioxanes." Wiley InterScience, Mar. 28, 2007.*

(Continued)

*Primary Examiner* — Ryan Walsh
*Assistant Examiner* — Philip Marcus T Fadul
(74) *Attorney, Agent, or Firm* — Cooper & Duham LLP

(57) ABSTRACT

A cleaning blade includes an elastic member configured to come into contact with a surface of a member to be cleaned and remove residual matter adhering to the surface of the member to be cleaned. The elastic member satisfies the following requirements a and b: a. The elastic member has a contact portion configured to come into contact with the surface of the member to be cleaned and the contact portion includes a modified layer that contains a cured product of an ultraviolet curable composition containing a (meth)acrylate compound; and b. A value obtained by normalizing a peak area ratio $S_A/S_B$ of a modified portion with a peak area ratio $S_A'/S_B'$ of a portion outside the modified layer is 1.5 or more and 10 or less where $S_A$ is a peak area value at 1162 $cm^{-1}$ and $S_B$ is a peak area value at 1533 $cm^{-1}$ obtained by infrared microspectrometry, and the modified portion is a region that extends 100 μm in a contact portion thickness inward direction from the contact portion on a plane that lies at an equal distance from two surfaces constituting the contact portion.

11 Claims, 7 Drawing Sheets

(56) References Cited

FOREIGN PATENT DOCUMENTS

| | | |
|---|---|---|
| JP | 2010-152295 | 7/2010 |
| JP | 2011-141449 | 7/2011 |
| JP | 2012-083729 | 4/2012 |

OTHER PUBLICATIONS

Schmidt et al. "Surface Studies of Polymer Blends." Macromolecules 1989, 22 4489-4495, Apr. 28, 1989.*

* cited by examiner

CLEANING BLADE, IMAGE FORMING APPARATUS, AND PROCESS CARTRIDGE

CROSS-REFERENCE TO RELATED APPLICATIONS

This patent application is based on and claims priority pursuant to 35 U.S.C. §119(a) to Japanese Patent Application No. 2013-148159, filed on Jul. 17, 2013, in the Japan Patent Office, the entire disclosure of which is hereby incorporated by reference herein.

BACKGROUND

1. Technical Field

The present invention relates to a cleaning blade that includes an elastic member that comes into contact with a surface of a member to be cleaned so as to remove residual matter adhering on the surface of the member to be cleaned.

2. Description of the Related Art

In a typical electrophotographic image forming apparatus, residual toner adhering to the surface of an image carrier after transfer of a toner image onto a recording medium or an intermediate transfer body during an image forming process is removed by cleaning means.

A cleaning blade is used as the cleaning means due to its simple structure and good cleaning performance. A typical cleaning blade includes an elastic member composed of polyurethane rubber or the like and a supporting member. A base end of the elastic member is supported by the supporting member and a contact portion (tip ridge) of the elastic member is pressed against the image carrier surface so as to block and scrape off the residual toner on the image carrier surface to carry out removal.

However, as illustrated in FIG. 1A, a cleaning blade 62 composed of polyurethane rubber is pulled in a direction in which an image carrier 123 moves due to increased frictional force between the image carrier 123 and the cleaning blade 62 and a contact portion (tip ridge) 62*c* of the cleaning blade 62 is bent back as a result. Once cleaning is continued with the contact portion 62*c* of the cleaning blade 62 in a bent-back state, local friction X occurs in a tip surface 62*a* of the cleaning blade 62 at a position several micrometers distant from the contact portion 62*c*, as illustrated in FIG. 1B. If cleaning is further continued under such a condition, the local friction X is increased and, as illustrated in FIG. 1C, the contact portion 62*c* ultimately comes to have a missing part. Toner cannot be appropriately cleaned with a contact portion 62*c* missing, resulting in cleaning failure. In FIGS. 1A to 1C, reference numeral 62*b* denotes a lower surface of the cleaning blade.

SUMMARY

A structure of the present invention for achieving the object is as described in (1) below:

(1) A cleaning blade includes an elastic member configured to come into contact with a surface of a member to be cleaned and remove residual matter adhering to the surface of the member to be cleaned, the elastic member satisfying requirements a and b below:

a. The elastic member has a contact portion configured to come into contact with the surface of the member to be cleaned and the contact portion includes a modified layer that contains a cured product of an ultraviolet curable composition containing a (meth)acrylate compound; and b. A value obtained by normalizing a peak area ratio $S_A/S_B$ of a modified portion with a peak area ratio $S_A'/S_B'$ of a portion outside the modified layer is 1.5 or more and 10 or less where $S_A$ is a peak area value at 1162 $cm^{-1}$ and $S_B$ is a peak area value at 1533 $cm^{-1}$ obtained by infrared microspectrometry, and the modified portion is a region that extends 100 μm in a contact portion thickness inward direction from the contact portion on a plane that lies at an equal distance from two surfaces constituting the contact portion.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1A:
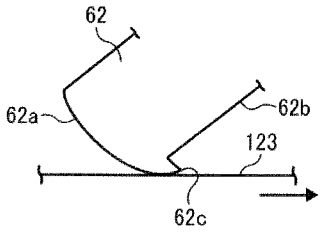
FIG. 1A is a diagram illustrating a state of bent-back contact portion of a typical cleaning blade.

The accompanying drawings are intended to depict example embodiments of the present invention and should not be interpreted to limit the scope thereof. The accompanying drawings are not to be considered as drawn to scale unless explicitly noted.

DETAILED DESCRIPTION

In order to reduce bending-back of the contact portion (tip ridge) of the cleaning blade coming into contact with the image carrier surface, an attempt has been made to increase the hardness of the contact portion so as to increase the resistance to deformation. For example, proposals have been made in which a surface layer containing ultraviolet-curable resin is formed in a contact portion of a cleaning blade or an elastic member so as to increase the hardness of the contact portion and prevent bending-back and deformation of the contact portion.

However, the ultraviolet-curable resins used in these proposals have a high crosslinking density and thus curing shrinkage that occurs during curing is significant. There is a problem in that when a surface layer composed of such a resin is formed on the contact portion, the surface layer may crack or detach.

A cleaning blade in which bending-back of a contact portion of an elastic member that comes into contact with a surface of a member to be cleaned is reduced, wear of the contact portion of the elastic member during use is less, and a good cleaning property is maintained over a long period of time is desirable.

In view of the above, one aspect of the present invention is to provide a cleaning blade in which bending-back of a contact portion of an elastic member, the contact portion coming into contact with a surface of a member to be cleaned, is suppressed, wear of the contact portion of the elastic member is less during use, and good cleaning performance can be maintained for a long period of time.

(Cleaning Blade)

A cleaning blade according to the present invention includes an elastic member configured to come into contact with a surface of a member to be cleaned and remove residual matter adhering to the surface of the member to be cleaned. The cleaning blade further includes a supporting member, and, if needed, other members.

The cleaning blade preferably includes a supporting member and a plate-shaped elastic member having one end connected to the supporting member and a free end portion of a particular length at the other end. The elastic member has a contact portion on the free end portion side and the elastic member is arranged so that the contact portion comes into contact with the surface of the member to be cleaned along the longitudinal direction.

<Member to be Cleaned>

The material, shape, structure, size, and the like of the member to be cleaned may be any and may be appropriately selected according to the purpose. Examples of the shape of the member to be cleaned include a drum shape, a belt shape, a plate shape, and a sheet shape. The size of the member to be cleaned is not particularly limited and may be appropriately selected according to the purpose; however, the size is preferably about typical size.

The material of the member to be cleaned is not particularly limited and may be appropriately selected according to the purpose. Examples thereof include metal, plastic, and ceramic materials.

The usage of the member to be cleaned is not particularly limited and may be appropriately selected according to the purpose. For example, when the cleaning blade is used in an image forming apparatus, the member to be cleaned is an image carrier.

<Residual Matter>

The residual matter may be any matter suitable for the purpose, adhering to the surface of the member to be cleaned, and subject to removal with the cleaning blade. Examples of the residual matter include a toner, a lubricant, inorganic fine particles, organic fine particles, dirt, dust, and mixtures of these.

<Supporting Member>

The shape, size, material, etc. of the supporting member may be any and may be appropriately selected according to the purpose. Examples of the shape of the supporting member include a plate shape, a strip shape, and a sheet shape. The size of the supporting member is not particularly limited and may be appropriately selected depending on the size of the member to be cleaned.

Examples of the material for the supporting member include metal, plastic, and ceramic materials. From the viewpoint of strength, a metal plate is preferable and a steel plate such as a stainless steel plate, an aluminum plate, and a phosphor bronze plate are particularly preferable.

<Elastic Member>

The shape, material, size, structure, etc. of the elastic member are not particularly limited and may be appropriately selected according to the purpose. Examples of the shape of the elastic member include a plate shape, a strip shape, and a sheet shape. The size of the elastic member is not particularly limited and may be appropriately selected according to the size of the member to be cleaned.

The material for the elastic member is not particularly limited and may be appropriately selected depending on the purpose. Polyurethane rubber and polyurethane elastomers are preferable since high elasticity can be easily obtained.

The method for making the elastic member is not particularly limited and may be appropriately selected according to the purpose.

For example, an elastic member may be made by preparing a polyurethane prepolymer by using a polyol compound and a polyisocyanate compound, adding a curing agent and, if needed, a curing catalyst to the polyurethane prepolymer to carry out crosslinking in a particular mold, placing the resulting product in a furnace to carry out post-crosslinking, forming the resulting product into a sheet by centrifugal forming, leaving and aging the resulting sheet at room temperature, and cutting the resulting sheet into a plate of particular dimensions.

The polyol compound is not particularly limited and may be appropriately selected according to the purpose. Examples thereof include high-molecular-weight polyols and low-molecular-weight polyols.

Examples of the high-molecular-weight polyols include a polyester polyol which is a condensate of an alkylene glycol and a fatty dibasic acid; a polyester-based polyol such as a polyester polyol of an alkylene glycol and adipic acid, e.g., ethylene adipate ester polyol, butylene adipate ester polyol, hexylene adipate ester polyol, ethylene propylene adipate ester polyol, ethylene butylene adipate ester polyol, and ethylene neopentylene adipate ester polyol; a polycaprolactone-based polyol such as polycaprolactone ester polyol obtained by ring-open polymerization of caprolactone; and a polyether-based polyol such as poly(oxytetramethylene)glycol and poly(oxypropylene)glycol. These may be used alone or in combination.

Examples of the low-molecular-weight polyols include dihydric alcohols such as 1,4-butanediol, ethylene glycol, neopentyl glycol, hydroquinone-bis(2-hydroxyethyl)ether, 3,3'-dichloro-4,4'-diaminodiphenyl methane, and 4,4'-diaminodiphenyl methane; and trihydric or higher alcohols such as 1,1,1-trimethylolpropane, glycerin, 1,2,6-hexanetriol, butanetriol, trimethylolethane, 1,1,1-tris(hydroxyethoxymethyl) propane, diglycerin, and pentaerythritol. These may be used alone or in combination.

The polyisocyanate compound is not particularly limited and may be appropriately selected according to the purpose. Examples thereof include methylene diphenyl diisocyanate (MDI), tolylene diisocyanate (TDI), xylylene diisocyanate (XDI), naphthylene 1,5-diisocyanate (NDI), tetramethylxylene diisocyanate (TMXDI), isophorone diisocyanate (IPDI) hydrogenated xylylene diisocyanate ($H_6$XDI), dicyclohexylmethane diisocyanate ($H_{12}$MDI), hexamethylene diisocyanate (HDI), dimer acid diisocyanate (DDI), norbornene diisocyanate (NBDI), and trimethyl hexamethylene diisocyanate (TMDI). These may be used alone or in combination.

The curing catalyst is not particularly limited and may be appropriately selected according to the purpose. Examples thereof include 2-methylimidazole and 1,2-dimethylimidazole.

The curing catalyst content is not particularly limited and may be appropriately selected according to the purpose. The curing catalyst content is preferably 0.01% by mass to 0.5% by mass and more preferably 0.05% by mass to 0.3% by mass.

The JIS-A hardness of the elastic member is not particularly limited and may be appropriately selected according to the purpose. The JIS-A hardness of the elastic member is preferably 60 or more and more preferably 65 to 80. At a JIS-A hardness less than 60, it is difficult to obtain a blade linear pressure and the area of the contact portion contacting the image carrier is likely to increase, possibly resulting in cleaning failure.

The elastic member is not particularly limited and may be appropriately selected according to the purpose. It is preferable to use a multilayered body formed by integrating two or more types of rubber with different JIS-A hardnesses since both wear resistance and following property can be achieved.

The JIS-A hardness of the elastic member can be measured by, for example, using a micro durometer MD-1 produced by KOBUNSHI KEIKI CO., LTD., The rebound resilience of the elastic member determined in accordance with JIS K 6255 standard is not particularly limited and may be appropriately selected according to the purpose. The rebound resilience is preferably 35% or less at 23° C. and more preferably 20% to 30% at 23° C. At a rebound resilience exceeding 35%, the elastic member of the cleaning blade exhibits stickiness and cleaning failure may result.

The rebound resilience of the elastic member can be measured by, for example, using a No. 221 resilience tester produced by Toyo Seiki Seisaku-Sho, Ltd., at 23° C. in accordance with JIS K 6255 standard.

The average thickness of the elastic member is not particularly limited and may be appropriately selected according to the purpose. The average thickness is preferably 1.0 mm to 3.0 mm.

The elastic member has a contact portion that comes into contact with the surface of the member to be cleaned and the contact portion includes a modified layer that contains a cured product of an ultraviolet (UV)-curable composition containing a (meth)acrylate compound. This means that the cured product of an ultraviolet (UV)-curable composition containing a (meth)acrylate compound may be present in the interior of the contact portion as well as on the surface of the contact portion. In the case where a surface layer is formed, the cured product of an ultraviolet (UV)-curable composition containing a (meth)acrylate compound is contained in the interior of the contact portion.

The cured product of the UV-curable composition may be present in a portion other than the contact portion of the elastic member so long as the cured product is contained at least in the contact portion of the elastic member.

As described above, a value is obtained by "normalizing a peak area ratio $S_A/S_B$ of a modified portion with a peak area ratio $S_A'/S_B'$ of a portion outside the modified layer" is in a particular range, where $S_A$ is a peak area value at 1162 $cm^{-1}$ and $S_B$ is a peak area value at 1533 $cm^{-1}$ obtained by infrared microspectrometry". To be more specific, the peak area at 1162 $cm^{-1}$ is due to urethane and the acryl compound used in the elastic member and the peak area at 1533 $cm^{-1}$ is due to urethane. Accordingly, when the peak area ratio $S_A/S_B$ is normalized by the peak area ratio $S_{A'}/S_{B'}$ of the portion outside the modified layer, the acryl penetration amount can be standardized.

The sample used in the infrared microspectrometry measurement is obtained by preparing a section of the cleaning blade and placing the section onto a Si wafer. The infrared microspectrometry is preferably of a transmission mode or an ATR mode. The infrared microspectrometer may be FT/IR-6200 spectrometer (with IRT-7000) produced by JASCO Corporation.

<<UV-Curable Composition>>

The UV curable composition contains a (meth)acrylate compound and other components as needed.

—(Meth)Acrylate Compound—

The UV curable composition contains a (meth)acrylate compound which may be any compound having a methacrylate group or an acrylate group. A (meth)acrylate compound having a low molecular weight readily penetrates the contact portion and thus modification can be carried out efficiently. Thus, a (meth)acrylate compound having a molecular weight of 100 to 1500 is preferable and a (meth)acrylate compound having a molecular weight of 500 or less is more preferable.

The (meth)acrylate compound having a molecular weight of 100 to 1500 is not particularly limited and may be appropriately selected according to the purpose.

Examples of the (meth)acrylate compound include dipentaerythritol hexa(meth)acrylate, pentaerythritol tetra(meth)acrylate, pentaerythritol tri(meth)acrylate, pentaerythritol ethoxy tetra(meth)acrylate, trimethylolpropane tri(meth)acrylate, trimethylolpropane ethoxy tri(meth)acrylate, 1,6-hexanediol di(meth)acrylate, ethoxylated bisphenol A di(meth)acrylate, propoxylated ethoxylated bisphenol A di(meth)acrylate, 1,4-butanediol di(meth)acrylate, 1,5-pentanediol di(meth)acrylate, 1,6-hexanediol di(meth)acrylate, 1,7-heptanediol di(meth)acrylate, 1,8-octanediol di(meth)acrylate, 1,9-nonanediol di(meth)acrylate, 1,10-decanediol di(meth)acrylate, 1,11-undecanediol di(meth)acrylate, 1,18-octadecanediol di(meth)acrylate, glycerin propoxy tri(meth)acrylate, dipropylene glycol di(meth)acrylate, dipropylene glycol di(meth)acrylate, PO-modified neopentyl glycol di(meth)acrylate, PEG600 di(meth)acrylate, PEG400 di(meth)acrylate, PEG200 di(meth)acrylate, neopentyl glycol hydroxypivalic acid ester di(meth)acrylate, octyl/decyl (meth)acrylate, isobornyl(meth)acrylate, ethoxylated phenyl (meth)acrylate, and 9,9-bis[4-(2-(meth)acryloyloxyethoxy) phenyl]fluorenone. These may be used alone or in combination. Among these, compounds having pentaerythritol triacrylate structures having 3 to 6 functional groups are preferable.

Examples of the compounds having pentaerythritol triacrylate structures having 3 to 6 functional groups include pentaerythritol triacrylate and dipentaerythritol hexaacrylate.

—(Meth)Acrylate Compound Having Alicyclic Structure Having 6 or More Carbon Atoms in Molecule—

A (meth)acrylate compound having an alicyclic structure having 6 or more carbon atoms in a molecule has a bulky, special alicyclic structure in its molecule; thus, a (meth)acrylate compound having a small number of functional groups and a low molecular weight can be used. Thus, the compound easily penetrates the contact portion of the elastic member and the hardness of the contact portion can be efficiently improved. In the case where a surface layer is formed on the contact portion, cracking and separation of the surface layer can be prevented.

The number of carbon atoms in the alicyclic structure of the (meth)acrylate compound having an alicyclic structure having 6 or more carbon atoms in a molecule is preferably 6 to 12 and more preferably 8 to 10. When the number of carbon atoms is 6 or more, the hardness of the contact portion is sufficiently high and when the number of carbon atoms is 12 or less, the possibility of steric hindrance is reduced.

The number of functional groups in the (meth)acrylate compound having an alicyclic structure having 6 or more carbon atoms in a molecule is preferably 2 to 6 and more preferably 2 to 4. Since the number of functional groups is 2 or more, the hardness of the contact portion is sufficiently high and since the number of functional groups is 6 or less, the possibility of steric hindrance is reduced.

The molecular weight of the (meth)acrylate compound having an alicyclic structure having 6 or more carbon atoms in a molecule is preferably 500 or less. When the molecular weight is 500 or less, the size of the molecule is small, the compound can easily penetrate the elastic member, and the hardness can be easily increased.

The (meth)acrylate compound having an alicyclic structure having 6 or more carbon atoms in a molecule is preferably at least one selected from a (meth)acrylate compound having a tricyclodecane structure and a (meth)acrylate compound having an adamantane structure since deficiency of crosslinking points can be compensated due to the special cyclic structure despite a small number of functional groups.

The (meth)acrylate compound having a tricyclodecane structure is not particularly limited and may be appropriately selected according to the purpose. Examples thereof include tricyclodecane dimethanol diacrylate and tricyclodecane dimethanol dimethacrylate.

The (meth)acrylate compound having a tricyclodecane structure may be synthesized as needed and used or may be purchased. An example of the commercially available product thereof is A-DCP (trade name) produced by Shin-Nakamura Chemical Co., Ltd.

The (meth)acrylate compound having an adamantane structure is not particularly limited and may be appropriately selected according to the purpose. Examples thereof include 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

The (meth)acrylate compound having an adamantane structure may be synthesized as needed and used or purchased. Examples of the commercially available product thereof include X-DA (trade name, produced by Idemitsu Kosan Co., Ltd.), X-A-201 (trade name, produced by Idemitsu Kosan Co., Ltd.), and ADTM (trade name, produced by Mitsubishi Gas Chemical Company, Inc.).

The content of the (meth)acrylate having an alicyclic structure having 6 or more carbon atoms in a molecule is not particularly limited and may be appropriately selected according to the purpose. The content relative to the UV curable composition is preferably 20% by mass to 100% by mass and more preferably 50% by mass to 100% by mass. When the content is 20% by mass or more, high hardness can be retained due to the special cyclic structure.

The fact that the (meth)acrylate compound having an alicyclic group having 6 or more carbon atoms in a molecule (in particular, preferably, a (meth)acrylate compound having a tricyclodecane structure or a (meth)acrylate compound having an adamantane structure) is contained in the contact portion of the elastic member that comes into contact with the surface of the member to be cleaned can be confirmed by infrared microspectrometry or liquid chromatography.

<Other Components>

Other components are not particularly limited and may be appropriately selected according to the purpose. Examples of other components include a photopolymerization initiator, a polymerization inhibitor, and a diluent.

—Photopolymerization Initiator—

The photopolymerization initiator may be any compound that generates active species, such as radicals or cations, by light energy and initiates polymerization and may be appropriately selected according to the purpose. Examples of the photopolymerization initiator include a photoradical polymerization initiator and a photocation polymerization initiator. Among these, a photoradical polymerization initiator is particularly preferable.

Examples of the photoradical polymerization initiator include aromatic ketones, acylphosphine oxide compounds, aromatic onium salt compounds, organic peroxides, thio compounds (thioxanthone compounds, thiophenyl-group-containing compounds, etc.), hexaaryl biimidazole compounds, ketoxime ester compounds, borate compounds, azinium compounds, metallocene compounds, active ester compounds, compounds having carbon-halogen bonds, and alkyl amine compounds.

The photoradical polymerization initiator is not particularly limited and may be appropriately selected according to the purpose. Examples thereof include acetophenone, acetophenone benzyl ketal, 1-hydroxycyclohexyl phenyl ketone, 2,2-dimethoxy-2-phenyl acetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methylpropan-1-one, 2-hydroxy-2-methyl-1-phenylpropan-1-one, thioxanthone, diethylthioxanthone, 2-isopropylthioxanthone, 2-chlorothioxanthone, 2-methyl-1-[4-(methylthio)phenyl]-2-morpholino-propan-1-one, bis(2,4,6-trimethylbenzoyl)-phenyl phosphine oxide, 2,4,6-trimethylbenzoyl-diphenyl-phosphine oxide, 2,4-diethylthioxanthone, and bis-(2,6-dimethoxybenzoyl)-2,4,4-trimethylpentylphosphine oxide. These may be used alone or in combination.

A commercially available product may be used as the photoradical polymerization initiator. Examples of the commercially available product include IRGACURE 651, IRGACURE 184, DAROCUR 1173, IRGACURE 2959, IRGACURE 127, IRGACURE 907, IRGACURE 369, IRGACURE 379, DAROCUR TPO, IRGACURE 819, IRGACURE 784, IRGACURE OXE 01, IRGACURE OXE 02, and IRGACURE 754 (all products available from Ciba Specialty Chemicals); Speedcure TPO (produced by Lambson); KAYACURE DETX-S (produced by Nippon Kayaku Co., Ltd.); Lucirin TPO, LR8893, and LR8970 (all products available from BASF); and EBECRYL P36 (produced by UCB). These can be used alone or in combination.

The content of the photopolymerization initiator is not particularly limited and may be appropriately selected according to the purpose. The content is preferably 1% by mass to 20% by mass relative to the UV curable composition.

—Polymerization Inhibitor—

The polymerization inhibitor is not particularly limited and may be appropriately selected according to the purpose. Examples of the polymerization inhibitor include phenolic compounds such as p-methoxy phenol, cresol, t-butyl catechol, di-t-butyl para-cresol, hydroquinone monomethyl ether, α-naphthol, 3,5-di-t-butyl-4-hydroxytoluene, 2,2'-methylene bis(4-methyl-6-t-butylphenol), 2,2'-methylene bis(4-ethyl-6-butylphenol), and 4,4'-thiobis(3-methyl-6-t-butylphenol); quinone compounds such as p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-di-butylhydroquinone, mono-t-butylhydroquinone, monomethyl hydroquinone, and 2,5-di-t-amylhydroquinone; amine compounds such as phenyl-β-naphthylamine, p-benzylaminophenol, di-β-naphthylparaphenylenediamine, dibenzylhydroxylamine, phenylhydroxylamine, and diethylhydroxylamine; nitro compounds such as dinitrobenzene, trinitrotoluene, and picric acid; oxime compounds such as quinone dioxime and cyclohexanone oxime; and sulfur compounds such as phenothiazine. These may be used alone or in combination.

—Diluent—

The diluent is not particularly limited and may be appropriately selected according to the purpose. Examples of the diluent include hydrocarbon-based solvents such as toluene and xylene; ester-based solvents such as ethyl acetate, n-butyl acetate, methyl cellosolve acetate, and propylene glycol monomethyl ether acetate; ketone-based solvents such as methyl ethyl ketone, methyl isobutyl ketone, diisobutyl ketone, cyclohexanone, and cyclopentanone; ether-based solvents such as ethylene glycol monomethyl ether, ethylene glycol monoethyl ether, and propylene glycol monomethyl ether; and alcohol-based solvents such as ethanol, propanol, 1-butanol, isopropyl alcohol, and isobutyl alcohol. These may be used alone or in combination.

The method for constructing a modified layer of an UV curable composition containing a (meth)acrylate compound in the contact portion of the elastic member is not particularly limited and may be appropriately selected according to the purpose. Examples of the method include the followings:

(1) A method that includes allowing the UV curable composition to penetrate the contact portion of the elastic member by applying the composition with a brush or through dip coating or the like and then curing the UV curable composition by applying UV light (2) A method that includes allowing the UV curable composition to penetrate the contact portion of the elastic member by applying the composition with a brush or through dip coating or the like, forming a surface layer by spraying an UV curable composition onto the contact portion, and performing curing under irradiation with UV light (3) A method that includes allowing the UV curable composition to penetrate the contact portion of the elastic member by applying the composition with a brush or through dip coating or the like, curing the UV curable composition by applying UV light, and forming a surface layer by spraying an UV curable composition onto the contact portion.

Of these methods, the method (1) is preferable.

UV irradiation conditions are not particularly limited and may be appropriately selected according to the purpose. The accumulated UV dose is preferably 500 mJ/cm$^2$ to 5,000 mJ/cm'.

The contact portion of the elastic member includes a modified layer that contains a cured product of an ultraviolet curable composition containing a (meth)acrylate compound. A value obtained by normalizing a peak area ratio $S_A/S_B$ of a modified portion with a peak area ratio $S_A'/S_B'$ of a portion outside the modified layer is 1.5 or more and 10 or less where $S_A$ is a peak area value at 1162 cm$^{-1}$, and $S_B$ is a peak area value at 1533 cm$^{-1}$ obtained by infrared microspectrometry, and the modified portion is a region that extends 100 μm in a contact portion thickness inward direction from the contact portion on a plane that lies at an equal distance from two surfaces constituting the contact portion.

According to this structure, the contact portion of the elastic member exhibits high hardness and curing and deformation of the contact portion can be suppressed. Moreover, since the composition penetrates inside the contact portion, curing and deformation can be suppressed even when the interior has become exposed by wear of the contact portion with time. The detailed account is given below.

According to the cleaning blade of the present invention, bending-back of a contact portion of the elastic member that comes into contact with a surface of a member to be cleaned can be suppressed, the wear of the contact portion of the elastic member during use is reduced, and a good cleaning property can be maintained over a long period of time. Accordingly, the cleaning blade of the present invention can be used in a wide variety of fields but is particularly suitable for use in an image forming apparatus, an image forming method, and a process cartridge of the present invention described below.

(Image Forming Apparatus and Image Forming Method)

An image forming apparatus according to the present invention includes at least an image carrier, charging means, exposing means, developing means, transferring means, fixing means, and cleaning means and, if needed, other means appropriately selected. The charging means and the exposing means together are sometimes referred to as electrostatic latent image forming means.

An image forming method used in the present invention includes at least a charging step, an exposing step, a developing step, a transferring step, a fixing step, and a cleaning step, and if needed, other steps appropriately selected. The charging step and the exposing step together are sometimes referred to as an electrostatic latent image forming step.

The image forming method used in the present invention can be appropriately implemented by using the image forming apparatus of the present invention. The charging step can be performed by using the charging means, the exposing step can be performed by using the exposing means, the developing step can be performed by the developing means, the transferring step can be performed by using the transferring means, the fixing step can be performed by using the fixing means, and the cleaning step can be performed by using the cleaning means. Other steps can be performed by using other means.

<Image Carrier>

The material, shape, structure, size, etc. of the image carrier (hereinafter may be referred to as "electrophotographic photosensitive member" or "photosensitive member") are not particularly limited and may be appropriately selected from those known in the art. Examples of the shape of the image carrier include a drum shape and a belt shape. Examples of the material of the image carrier include inorganic photoconductors such as amorphous silicon and selenium and organic photoconductors (OPC) such as polysilane and phthalopolymethine.

<Charging Step and Charging Means>

The charging step is a step of charging a surface of the image carrier and is performed by using charging means.

Charging is performed by, for example, applying a voltage onto the surface of the image carrier by using the charging means.

The charging means is not particularly limited and may be appropriately selected according to the purpose. Examples of the charging means include known contact chargers equipped with conductive or semiconductive rollers, brushes, films, rubber blades, and the like, and non-contact chargers that use corona discharge such as corotron, scorotron, and the like.

The charging means may be a roller, a magnetic brush, or a fur brush, or may take any other form and can be selected according to the specifications and mode of the electrophotographic image forming apparatus. In the case where a magnetic brush is used, the magnetic brush is constituted by, for example, any of various types of ferrite particles, such as Zn—Cu ferrite, as charging means, a nonmagnetic conductive sleeve for supporting the ferrite particles, and a magnet roll included in the conductive sleeve. Alternatively, in the case where a brush is used, a fur that has been made conductive by using carbon, copper sulfide, metal, or a metal oxide is used as the material for the fur brush and a charger is formed by wrapping or bonding the fur around a metal or other conductive core.

The charger is not limited to the contact charger described above but a contact charger is advantageous in that an image forming apparatus can be obtained in which the amount of ozone generated from the charger is decreased.

The charger is preferably arranged in a contact or noncontact manner with respect to the image carrier and preferably charges the surface of the image carrier by simultaneous imposition of DC and AC voltages.

Alternatively, the charger is preferably a charging roller arranged in a noncontact manner near an image carrier that has a gap tape and the charger preferably charges the surface of the image carrier by simultaneously imposing DC and AC voltages to the charging roller.

<Exposing Step and Exposing Means>

The exposing step is a step of exposing the charged surface of the image carrier and is performed by using the exposing means.

For example, the exposure can be performed by illuminating the surface of the image carrier such that an electrostatic latent image is formed on the surface of the image carrier.

Optical systems used in the exposure can be roughly categorized into analog optical systems and digital optical systems. In the analog optical systems, the original is directly projected onto the image carrier. In the digital optical systems, image information is supplied as an electric signal and the electric signal is converted into an optical signal to expose the electrophotographic photosensitive member and form an electrostatic latent image.

The exposing means is not particularly limited as long as the image carrier surface charged by the charging means can be illuminated with light so as to form an electrostatic latent image and may be appropriately selected according to the purpose. Examples of the exposing means include various exposure devices such as copying optical systems, rod lens array systems, laser optical systems, liquid crystal shutter optical systems, and LED optical systems.

In the present invention, a back illumination method for performing exposure from the back surface of the image carrier can be used to form an electrostatic latent image.

<Developing Step and Developing Means>

The developing step is a step of forming a visible image by developing the electrostatic latent image with the toner.

Formation of the visible image can be carried out by developing the electrostatic latent image with the toner and by using the developing means.

The developing means may be any means capable of developing with the toner and may be appropriately selected from those known in the art. An example of a preferable developing means is a device that at least includes a developing device that can store the toner and supply the toner to the electrostatic latent image in a contact or noncontact manner.

The developing device may be of a dry development type or a wet development type and may be of a single-color type or a multicolor type. An example of the developing device is a device that includes a stirrer that charges the toner by friction caused by stirring and a rotatable magnet roller.

In the developing device, for example, the toner and, if needed, a carrier are mixed and stirred and the toner is charged by the friction generated by the stirring and forms chains retained on the surface of the rotating magnet roller to form a magnetic brush. Since the magnet roller is disposed near the image carrier, part of the toner constituting the magnetic brush formed on the surface of the magnet roller moves to the surface of the image carrier by electrical attraction. Consequently, the electrostatic latent image is developed with the toner and a visible image is formed by the toner on the surface of the image carrier.

The toner contained in the developing device may be a developing agent that contains the toner. The developing agent may be a one-component developing agent or a two-component developing agent.

—Toner—

The toner contains toner base particles and an external additive, and, if needed, other components.

The toner may be a monochrome toner or a color toner.

The toner base particles contain at least a binder resin and a coloring agent and, if needed, a releasing agent, a charge controller, and other components.

———Binder Resin———

The binder resin is not particularly limited and may be appropriately selected according to the purpose. Examples of the binder resin include homopolymers of styrene or its substitute such as polystyrene resin and polyvinyl toluene resin, a styrene-p-chlorostyrene copolymer, a styrene-propylene copolymer, a styrene-vinyl toluene copolymer, a styrene-methyl acrylate copolymer, a styrene-ethyl acrylate copolymer, a styrene-butyl acrylate copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ether copolymer, a styrene-vinyl methyl ketone copolymer, a styrene-butadiene copolymer, a styrene-isoprene copolymer, a styrene-maleic acid copolymer, a styrene-maleic acid ester copolymer, polymethyl methacrylate, polybutyl methacrylate, polyvinyl chloride resin, polyvinyl acetate resin, polyethylene resin, polypropylene resin, polyester resin, polyurethane resin, epoxy resin, polyvinyl butyral resin, polyacrylic acid resin, rosin, modified rosin, terpene resin, phenolic resin, aliphatic hydrocarbons, aromatic petroleum resin, chlorinated paraffin, and paraffin wax. These may be used alone or in combination. Among these, polyester resin is particularly preferable since polyester resin can decrease the melt viscosity while maintaining the stability of the toner during storage compared to styrene-based resin and acryl-based resin.

The polyester resin can be obtained by, for example, polycondensation reaction of an alcohol component and a carboxylic acid component.

The alcohol component is not particularly limited and may be appropriately selected according to the purpose.

Examples of the alcohol component include diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, polyoxyethylenated bisphenol A, and polyoxypropylenated bisphenol A; dihydric alcohol units of the aforementioned substituted with saturated or unsaturated hydrocarbon groups with 3 to 22 carbon atoms; other dihydric alcohol units; and trihydric or higher alcohol monomers such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The carboxylic acid component is not particularly limited and may be appropriately selected according to the purpose.

Examples of the carboxylic acid component include monocarboxylic acids such as palmatic acid, stearic acid, and oleic acid; maleic acid, fumaric acid, mesaconic acid, citraconic acid, terephthalic acid, cyclohexane dicarboxylic acid, succinic acid, adipic acid, sebacic acid, malonic acid, divalent organic acid monomers of these substituted with saturated or unsaturated hydrocarbon groups with 3 to 22 carbon atoms, acid anhydrides of these, and dimer acids from lower alkyl esters and linoleic acid; and 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 3,3-dicarboxymethyl butanoic acid, tetracarboxymethylmethane, 1,2,7,8-octanetetracarboxylic acid empol trimer acids, trivalent or higher carboxylic acid monomers such as anhydrides of the aforementioned acids.

———Coloring Agent———

The coloring agent is not particularly limited and may be appropriately selected from known dyes and pigments according to the purpose.

Examples of the coloring agent include carbon black, nigrosine dye, iron black, Naphthol Yellow S, Hansa Yellow (10G, 5G, G), cadmium yellow, yellow iron oxide, yellow ocher, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine lake, Quinoline Yellow lake, Anthrazane Yellow BGL, isoindolinone yellow, red iron oxide, red lead, lead vermillion, cadmium red, cadmium mercury red, antimony vermillion, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosine Lake, Rhodamine Lake B, Rhodamine Lake Y, Alizarin Lake, Thioindigo Red B, Thioindigo Maroon, Oil Red, Quinacridone Red, Pyrazolone Red, Polyazo Red, Chrome Vermillion, Benzidine Orange, Perinone Orange, Oil Orange, Cobalt Blue, Cerulean Blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine blue, Prussian blue, anthraquinone blue, Fast Violet B, Methyl Violet Lake, Cobalt Violet, Manganese Violet, Dioxane Violet, Anthraquinone Violet, Chrome Green, Zinc Green, chromium oxide, viridian, emerald green, Pigment Green B, Naphthol Green B, Green Gold, Acid Green lake, Malachite Green Lake, Phthalocyanine Green, Anthraquinone Green, titanium oxide, zinc oxide, and lithopone. These may be used alone or in combination.

The content of the coloring agent in the toner is not particularly limited and may be appropriately selected according to the purpose. The content is preferably 1% by mass to 15% by mass and more preferably 3% by mass to 10% by mass.

The coloring agent may be combined with a resin to form a master batch. The resin is not particularly limited and may be appropriately selected from those known in the art according to the purpose. Examples of the resin include polymers of substituted or unsubstituted styrene, styrene-based copolymers, polymethyl methacrylate resin, polybutyl methacrylate reins, polyvinyl chloride resin, polyvinyl acetate resin, polyethylene resin, polypropylene resin, polyester resin, epoxy resin, epoxypolyol resin, polyurethane resin, polyamide resin, polyvinyl butyral resin, polyacrylic acid resin, rosin, modified rosin, terpene resin, aliphatic hydrocarbon resin, alicyclic hydrocarbon resin, aromatic petroleum resin, chlorinated paraffin, and paraffin. These may be used alone or in combination.

———Releasing Agent———

The releasing agent is not particularly limited and may be appropriately selected according to the purpose. Examples of the releasing agent include waxes.

Examples of the waxes include carbonyl group-containing wax, polyolefin wax, and long chain hydrocarbons. These can be used alone or in combination. Among these, carbonyl group-containing wax is preferable.

Examples of the carbonyl group-containing wax include polyalkanoic acid ester, polyalkanol ester, polyalkanoic acid amide, polyalkyl amide, and dialkyl ketone. Examples of the polyalkanoic acid ester include carnauba wax, montane wax, trimethylol propane tribehenate, pentaerythritol tetrabehenate, pentaerythritol diacetate dibehenate, glycerin tribehenate, and 1,18-octadecanediol distearate. Examples of the polyalkanol ester include tristearyl trimellitate and distearyl maleate. An example of the polyalkanoic acid amide is dibehenyl amide. An example of the polyalkyl amide is trimellitic acid tristearylamide. An example of the dialkyl ketone is distearyl ketone. Among these carbonyl group-containing waxes, polyalkanoic acid ester is particularly preferable.

Examples of the polyolefin wax include polyethylene wax and polypropylene wax.

Examples of the long-chain hydrocarbon include paraffin wax and sasol wax.

The content of the releasing agent in the toner is not particularly limited and may be appropriately selected according to the purpose. The content is preferably 5% by mass to 15% by mass.

———Charge Controller———

The charge controller is not particularly limited and may be appropriately selected according to the purpose. Examples of the charge controller include nigrosin-based dyes, triphenylmethane-based dyes, chromium-containing metal complex dyes, molybdic acid chelate pigments, rhodamine-based dyes, alkoxy-based amine, quaternary ammonium salts (including fluorine-modified quaternary ammonium salts), alkyl amide, elemental phosphorus, phosphorus compounds, elemental tungsten, tungsten compounds, fluorine-based activators, salicylic acid metal salts, and metal salts of salicylic acid derivatives.

The content of the charge controller is not particularly limited and may be appropriately selected according to the purpose. The content is preferably 0.1 parts by mass to 10 parts by mass and more preferably 0.2 parts by mass to 5 parts by mass per 100 parts by mass of the toner.

——External Additive——

The external additive may be any material containing at least silica particles and may be appropriately selected according to the purpose. Examples of the external additive include inorganic particles such as silica, titanium oxide, alumina, silicon carbide, silicon nitride, and boron nitride, and resin particles such as polymethyl methacrylate particles and polystyrene particles having an average particle size of 0.05 μm to 1 μm obtained by a soap-free emulsion polymerization method. These may be used alone or in combination. Among these, silica having hydrophobized surfaces is particularly preferable.

An example of the silica is silicone-treated silica. Silicone-treated silica is silica surface-treated (hydrophobized) with silicone oil.

The method of the surface treatment is not particularly limited and may be appropriately selected according to the purpose.

Examples of the silicone oil include dimethyl silicone oil, methyl hydrogen silicone oil, and methyl phenyl silicone oil.

The silicone-treated silica may be a commercially available product. Examples of the commercially available products include RY200, R2T200S, NY50, and RY50 (all available from Nippon Aerosil Co., Ltd.).

——Other Components———

Other components contained in the toner are not particularly limited and may be appropriately selected according to the purpose. Examples of other components include a flow improver, a cleaning property improver, a magnetic material, and a metal soap.

The flow improver is used in the surface treatment to enhance the hydrophobicity so that the flowing properties and charging properties are prevented from degrading even at high humidity. Examples of the flow improver include a silane coupling agent, a silylating agent, a silane coupling agent containing an alkyl fluoride group, an organic titanate-based coupling agent, an aluminum-based coupling agent, silicone oil, and modified silicone oil.

The cleaning property improver is added to the toner to facilitate removal of the toner remaining on the image carrier or the intermediate transfer body after the transfer. Examples of the cleaning property improver include fatty acid metal salts such as zinc stearate, calcium stearate, and stearic acid and polymer fine particles produced by soap-free emulsion polymerization, such as polymethyl methacrylate fine particles and polystyrene fine particles. The polymer fine particles preferably have a narrow particle size distribution and preferably have a volume-average particle diameter of 0.01 μm to 1 μm.

The magnetic material is not particularly limited and may be appropriately selected according to the purpose. Examples of the magnetic material include iron powder, magnetite, and ferrite. From the viewpoint of color tone, a white magnetic material is preferable.

——Method for Making Toner——

The method for making toner is not particularly limited and may be appropriately selected from among the known methods for making toners according to the purpose. Examples of the method include a kneading and pulverizing method, a polymerization method, a solution suspension method, and an atomizing method. Among these, a polymerization method such as a suspension polymerization method, an emulsion polymerization method, or a dispersion polymerization method is preferable since the toner can be made small and highly circular and the image quality can be improved.

———Kneading and Pulverizing Method———

The kneading and pulverizing method includes melt-kneading a toner material containing at least a binder resin and a coloring agent, pulverizing the resulting kneaded product, and classifying the pulverized product to make base particles of the toner.

In the melt kneading process described above, the toner material is prepared by mixing and the resulting mixture is placed in a melt kneader to perform melt kneading. As a melt kneader, for example, a single- or twin-screw continuous kneader or a batch kneader equipped with a roll mill can be used. Examples of the kneader include a KTK-type twin screw extruder produced by Kobe Steel Ltd., a TEM-type extruder produced by Toshiba Machine Co., Ltd., a twin screw extruder produced by KCK, a PCM-type twin screw extruder produced by Ikegai Ironworks Corporation, and a co-kneader produced by Buss AG. In particular, the melt kneading is preferably performed under appropriate conditions that do not cause breaking of molecular chains in the binder resin. The melt kneading temperature is determined with respect to the softening point of the binder resin. If the melt kneading temperature is excessively higher than the softening point, significant breaking of molecular chains occurs and if the melt kneading temperature is excessively lower than the softening point, dispersing may not proceed smoothly.

In the pulverizing process, the kneaded product obtained by the melt kneading is pulverized. The kneaded product is preferably first roughly pulverized and then finely pulverized. Examples of preferable methods for pulverizing the kneaded product include a process of causing the kneaded product to collide with a collision plate in a jet stream, a process of causing particles of the kneaded product to collide with one another in a jet stream, and a process of pulverizing the kneaded product in a narrow gap between a stator and a mechanically rotated rotor.

In the classifying process, the pulverized product obtained by pulverizing is classified into particles of particular particle diameters. Classifying can be performed by using a cyclone, a decanter, a centrifugal separator, or the like by removing fine particles.

Upon completion of pulverizing and classifying, the pulverized product is further classified in air stream through centrifugal force etc., so as to make toner base particles having a particular particle diameter.

Next, an external additive is externally added to the toner base particles. The toner base particles and the external additive are mixed with each other and stirred in a mixer so that the external additive coats the surfaces of the toner base particles while being disintegrated. It is important that the external additive, such as silica particles, be uniformly and strongly adhered to the toner base particles from the viewpoint of durability.

———Polymerization Method———

A toner may be made by a polymerization method as follows. First, a toner material containing a coloring agent and a modified polyester-based resin that can form urea or urethane bonds is dissolved and dispersed in an organic solvent. The resulting solution or dispersion is then dispersed in an aqueous medium to conduct polyaddition reaction, the solvent is removed from the resulting dispersion, and the residue is washed to obtain a toner.

Examples of the modified polyester-based resin that can form urea or urethane bonds include isocyanate group-containing polyester prepolymers obtained by reacting polyvalent isocyanate compounds (PIC) with carboxyl groups, hydroxyl groups, etc., at the polyester termini. A modified polyester resin obtained by crosslinking and/or elongation of molecular chains caused by the reaction between the polyester prepolymer and an amine can improve a hot offset property while maintaining low-temperature fixability.

Examples of the polyvalent isocyanate compounds (PIC) include fatty polyvalent isocyanates (e.g., tetramethylene diisocyanate, hexamethylene diisocyanate, and 2,6-diisocyanatomethyl caproate); alicyclic polyisocyanates (e.g., isophorone diisocyanate and cyclohexyl methane diisocyanate);

aromatic diisocyanates (e.g., tolylene diisocyanate and diphenyl methane diisocyanate); aromatic aliphatic diisocyanates (e.g., α,α,α',α'-tetramethylxylylene diisocyanate); isocyanates; and the polyisocyanates mentioned above blocked with a phenol derivative, oxime, caprolactam, or the like. These may be used alone or in combination.

The ratio of the polyvalent isocyanate compound (PIC) is not particularly limited and may be appropriately selected according to the purpose. The equivalent ratio of the isocyanate groups [NCO] to the hydroxyl groups [OH] of the hydroxyl group-containing polyester, [NCO]/[OH], is preferably 5/1 to 1/1, more preferably 4/1 to 1.2/1, and most preferably 2.5/1 to 1.5/1.

The number of isocyanate groups contained in one molecule of an isocyanate group-containing polyester prepolymer (A) is not particularly limited and may be appropriately selected according to the purpose. The number of isocyanate groups is preferably 1 or more, more preferably 1.5 to 3 on average, and most preferably 1.8 to 2.5 on average.

Examples of the amine (B) to be reacted with the polyester prepolymer include a divalent amine compound (B1), a trivalent or higher amine compound (B2), an amino alcohol (B3), an amino mercaptan (B4), an amino acid (B5), and a compound (B6) which is any of B1 to B5 but with blocked amino groups.

Examples of the divalent amine compound (B1) include aromatic diamines (e.g., phenylene diamine, diethyl toluene diamine, 4,4'-diaminodiphenylmethane, etc.); alicyclic diamines (e.g., 4,4'-diamino-3,3'-dimethyldicyclohexylmethane, diaminecyclohexane, and isophoronediamine); and fatty diamines (e.g., ethylene diamine, tetramethylene diamine, and hexamethylene diamine).

Examples of the trivalent or higher amine compound (B2) include diethylenetriamine and triethylenetetramine.

Examples of the amino alcohol (B3) include ethanolamine and hydroxyethylaniline.

Examples of the amino mercaptan (B4) include aminoethyl mercaptan and aminopropyl mercaptan.

Examples of the amino acid (B5) include aminopropionic acid and aminocaproic acid.

Examples of the compound (B6) which is any one of B1 to B5 above but with blocked amino groups include ketimine compounds and oxazolidine compounds obtained from ketones (e.g., acetone, methyl ethyl ketone, and methyl isobutyl ketone) and amines of B1 to B5. Among the amines (B), B1 and a mixture of B1 and a small amount of B2 are particularly preferable.

The ratio of the amine (B) is not particularly limited and may be appropriately selected according to the purpose. The equivalent ratio of the isocyanate groups [NCO] in the isocyanate group-containing polyester prepolymer (A) to the amino groups [NHx] in the amine (B), [NCO]/[NHx], is preferably 1/2 to 2/1, more preferably 1.5/1 to 1/1.5, and most preferably 1.2/1 to 1/1.2.

According to the method for making a toner by a polymerization method described above, a small-diameter spherical toner can be manufactured at low cost and with less impact on the environment.

A disperser used for dispersing is not particularly limited and may be appropriately selected according to the purpose. Examples of the disperser include a low-speed shear-type disperser, a high-speed shear-type disperser, a friction-type disperser, a high-pressure jet-type disperse, and an ultrasonic disperser.

Among these, a high-speed shear-type disperser is preferable since the particle size of the dispersed bodies (oil droplets) can be controlled to 2 μm to 20 μm.

The conditions such as the number of rotations, dispersing time, and dispersing temperature of the high-speed shear-type disperser may be appropriately selected according to the purpose.

The number of rotations is not particularly limited and may be appropriately selected according to the purpose. The number of rotation is preferably 1,000 rpm to 30,000 rpm and more preferably 5,000 rpm to 20,000 rpm.

The dispersing time is not particularly limited and may be appropriately selected according to the purpose. In a batch method, the dispersing time is preferably 0.1 to 5 minutes.

The dispersing temperature is not particularly limited and may be appropriately selected according to the purpose. The dispersing temperature under pressure is preferably 0° C. to 150° C. and more preferably 40° C. to 98° C. In general, the higher the dispersing temperature, the easier the dispersing operation.

The amount of the aqueous medium used for dispersing the toner material in the aqueous medium is not particularly limited and may be appropriately selected according to the purpose. The amount of the aqueous medium used is preferably 50 parts by mass to 2,000 parts by mass and more preferably 100 parts by mass to 1,000 parts by mass relative to 100 parts by mass of the toner material.

The method for removing the organic solvent from the dispersion is not particularly limited and may be appropriately selected according to the purpose. For example, the whole reaction system may be slowly heated to evaporate the organic solvent in the oil droplets or the dispersion may be sprayed in a dry atmosphere so as to remove the organic solvent in the oil droplets.

Once the organic solvent is removed, toner base particles are formed. The toner base particles may be washed, dried, etc., and further classified, for example. The classifying may be performed by removing fine particles in liquid using a cyclone, a decanter, or a centrifugal separator, or by conducting classification after drying.

The resulting toner base particles may be mixed with the external additive and, if needed, particles such as a charge controller. During mixing, mechanical impact may be applied to suppress detachment of the particles, such as the external additive, from the surfaces of the toner base particles.

The method for applying mechanical impact is not particularly limited and may be appropriately selected according to the purpose. For example, impact may be applied to the mixture by using a blade rotating at high speed or the mixture may be placed in a high-speed air stream to accelerate particles and cause the particles to collide with each other or with a collision plate.

The device used in this method is not particularly limited and may be appropriately selected according to the purpose.

Examples of the device include Angmill (produced by Hosokawa Micron Corporation), I-type mill (produced by Nippon Pneumatic Mfg. Co., Ltd.) modified to decrease the pulverizing air pressure, Hybridization System (produced by Nara Machinery Co., Ltd.), Criptron System (produced by Kawasaki Heavy Industries, Ltd.), and an automatic mortar.

The average circularity of the toner is not particularly limited and may be appropriately selected according to the purpose. The average circularity is preferably 0.97 or more and more preferably 0.97 to 0.98. At an average circularity less than 0.97, a satisfactory transfer property and/or a high-quality image free of scattering may not always be obtained.

The average circularity of the toner can be measured with, for example, a flow particle image analyzer FPIA-1000 produced by Sysmex Corporation.

The volume-average particle diameter of the toner is not particularly limited and may be appropriately selected according to the purpose. The volume-average particle diameter is preferably 5.5 μm or less.

The ratio (Dv/Dn) of the volume-average particle diameter (Dv) to the number-average particle diameter (Dn) is not particularly limited and may be appropriately selected according to the purpose. The ratio (Dv/Dn) is preferably 1.00 to 1.40. The closer the ratio (Dv/Dn) to 1.00, the sharper the particle diameter distribution. A toner that has a small particle diameter and a narrow particle diameter distribution achieves a uniform charge amount distribution and a high-quality image with less background fogging can be obtained. Moreover, in an electrostatic transfer system, the transfer ratio can be increased.

The volume-average particle diameter and the particle size distribution of the toner can be measured by, for example, a Coulter counter method. Examples of the device used for measuring the particle size distribution of the toner particles by the Coulter counter method include Coulter Counter TA-II and Coulter Multisizer II (both available from Coulter Corporation).

The toner may be mixed with a magnetic carrier and used as a two-component developing agent. The mass ratio of the toner to the carrier in the two-component developing agent is not particularly limited and may be appropriately selected according to the purpose. Preferably, 1 to 10 parts by mass of the toner is contained per 100 parts of the carrier.

Examples of the magnetic carrier include iron powder having a particle diameter of about 20 μm to 200 μm, ferrite powder, magnetite powder, and a magnetic resin carrier.

The coating resin is not particularly limited and may be appropriately selected according to the purpose. Examples of the coating resin include urea-formaldehyde resin, melamine resin, benzoguanamine resin, urea resin, polyamide resin, epoxy resin, polyvinyl and polyvinylidene-based resin, acrylic resin, polymethyl methacrylate resin, polyacrylonitrile resin, polyvinyl acetate resin, polyvinyl alcohol resin, polyvinyl butyral resin, polystyrene resin, styrene-acryl copolymer resin, halogenated olefin resin such as polyvinyl chloride resin, polyester-based resin such as polyethylene terephthalate resin and polybutylene terephthalate resin, polycarbonate-based resin, polyethylene resin, polyvinyl fluoride resin, polyvinylidene fluoride resin, polytrifluoroethylene resin, polyhexafluoropropylene resin, a copolymer of vinylidene fluoride and an acrylic monomer, a copolymer of vinylidene fluoride and vinyl fluoride, a fluoro-terpolymer such as a terpolymer of tetrafluoroethylene, vinylidene fluoride, and an unfluorinated monomer, and silicone resin.

If needed, conductive powder or the like may be added to the coating resin. Examples of the conductive powder include metal powder, carbon black, titanium oxide, tin oxide, and zinc oxide. These conductive powders preferably have an average particle diameter of 1 μm or less. At an average particle diameter exceeding 1 μm, it may become difficult to control the electrical resistance.

The toner can be used as a one-component magnetic toner that does not use any carrier or as a non-magnetic toner, <Transferring Step and Transferring Means>

The transfer step is a step of transferring the visible image onto a recording medium. Preferably, the visible image is first transferred onto an intermediate transfer body (primary transfer) and then onto a recording medium (secondary transfer).

More preferably, the transfer step includes a primary transfer step of transferring visible images onto an intermediate transfer body by using two or more colors of toner and more preferably by using full-color toners so as to form a combined transfer image and a secondary transfer step of transferring the combined transfer image onto a recording medium.

The transfer of the visible image can be carried out by charging the image carrier by using transferring means. The aforementioned transferring means may be used. The transferring means preferably includes primary transfer means for transferring visible images onto an intermediate transfer body so as to form a combined transfer image and secondary transfer means for transferring the combined transfer image onto a recording medium.

The intermediate transfer body is not particularly limited and may be appropriately selected according to the purpose from among known transfer bodies. An example thereof is a transfer belt.

The transfer means (primary transfer means and secondary transfer means) preferably includes at least a transfer device configured to separate the visible image on the image carrier toward the recording medium side by charging. The number of transferring means may be 1 or more. Examples of the transfer device include a corona transfer device that uses corona discharge, a transfer belt, a transfer roller, a pressure transfer roller, and an adhesive transfer device.

The recording medium is typically regular paper but may be any other medium onto which an unfixed image after development can be transferred. The recording medium may be appropriately selected according to the purpose and may be a polyethylene terephthalate (PET) base for overhead projectors (OHP).

<Fixing Step and Fixing Means>

The fixing step is a step of fixing a toner image transferred onto a recording medium and fixing means can be used to perform the fixing step. When two or more colors of toners are used, fixing may be performed every time a particular color toner is transferred onto a recording medium or after all color toners are transferred and stacked onto a recording medium. The fixing means may be any and may be a thermal fixing method that uses known heating and pressurizing means. Examples of the heating and pressurizing means include a combination of a heating roller and a pressurizing roller and a combination of a heating roller, a pressurizing roller, and an endless belt. During this process, the heating temperature is not particularly limited and may be appropriately selected according to the purpose. The heating temperature is preferably 80° C. to 200° C. If needed, a known optical fixing device can be used together with the fixing means, for example.

<Cleaning Step and Cleaning Means>

The cleaning step is a step of removing the toner remaining on the image carrier and is preferably performed by cleaning means.

An example of the cleaning means is the cleaning blade of the present invention described above.

The elastic member of the cleaning blade is not particularly limited and may be appropriately selected according to the purpose. Preferably, the elastic member contacts the surface of the image carrier at a pressing force of 10 N/m to 100 N/m. When the pressing force is less than 10 N/m, the toner slips through the contact site of the elastic member of the cleaning blade making contact with the surface of the image carrier, possibly resulting in cleaning failure. When the pressing force exceeds 100 N/m, the friction force at the contact site is increased and the cleaning blade may become bent back. The pressing force is more preferably 10 N/m to 50 N/m.

The pressing force can be measured by a measuring instrument equipped with a small-sized compact compression load cell produced by Kyowa Electronic Instruments Co., Ltd., for example.

The angle θ formed between an end surface of the cleaning blade and a tangent line at a position where the elastic member of the cleaning blade comes into contact with the surface of the image carrier is not particularly limited and may be appropriately selected according to the purpose. The angle is preferably 65° or more and 85° or less.

When the angle θ is less than 65°, the cleaning blade may become bent back. When the angle θ is more than 85°, cleaning failure may result.

<Other Steps and Other Means>

Examples of other steps include a charge erasing step, a recycling step, and a controlling step.

Examples of other means include charge erasing means, recycling means, and controlling means.

—Charge Erasing Step and Charge Erasing Means—

The charge erasing step is a step of erasing charges by applying a charge erasing bias to the image carrier. The charge erasing step is preferably performed by using charge erasing means.

The charge erasing means may be any means capable of applying a charge erasing bias to the image carrier and may be appropriately selected from known charge erasers. An example thereof is a charge erasing lamp.

—Recycling Step and Recycling Means—

The recycling step is a step of recycling the toner removed in the cleaning step so that the toner can be returned to the developing means. The recycling step is preferably performed by recycling means.

The recycling means may be any and may be a known transporting means or the like.

—Controlling Step and Controlling Means—

The controlling step is a step of controlling the respective steps and is preferably performed by controlling means.

The controlling means may be any means capable of controlling operation of the respective means and may be appropriately selected according to the purpose. Examples of the controlling means include devices such as a sequencer and a computer.

An example of an image forming apparatus according to the present invention will now be described with reference to the drawings.

Figure 2:
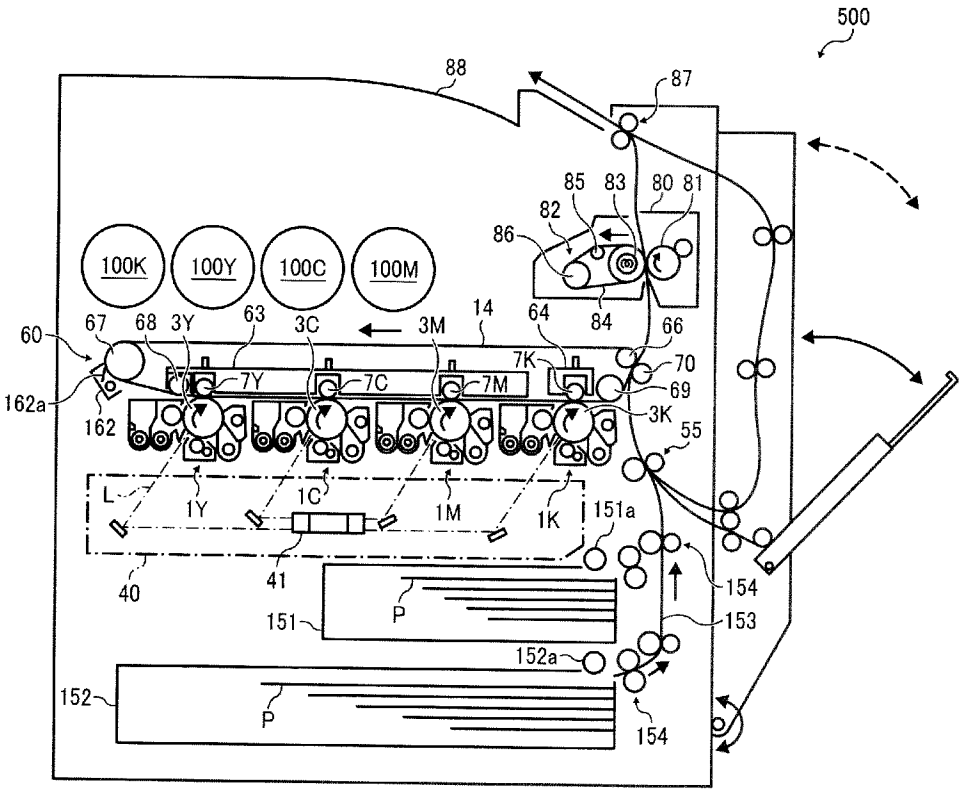
FIG. 2 is a schematic diagram illustrating one example of an image forming apparatus according to an embodiment of the present invention.

FIG. 2 is a schematic view illustrating an example of an image forming apparatus 500 according to the present invention. The image forming apparatus 500 includes four image forming units 1Y, 1C, 1M, and 1K for yellow, magenta, cyan, and black (hereinafter may be referred to as Y, C, M and K), respectively. These image forming units respectively use Y, C, M, and K toners as the substance for forming images but otherwise have the same structure.

A transfer unit 60 that includes an intermediate transfer belt 14 serving as an intermediate transfer body is disposed above the image forming units 1Y, 1C, 1M and 1K. Toner images of respective colors formed on photosensitive members 3Y, 3C, 3M, and 3K included in the image forming units 1Y, 1C, 1M and 1K are transferred onto the surface of the intermediate transfer belt 14 by being superimposed on one another.

An optical write unit 40 is disposed below the image forming units 1Y, 1C, 1M and 1K. The optical write unit 40 is latent image forming means. The optical write unit 40 applies laser beams L emitted based on image data to the photosensitive members 3Y, 3C, 3M, and 3K of the image forming units 1Y, 1C, 1M and 1K. As a result, electrostatic latent images for Y, C, M and K are formed on the photosensitive members 3Y, 3C, 3M, and 3K. The optical write unit 40 is configured to apply laser beams from a light source to the photosensitive members 3Y, 3C, 3M, and 3K through plural optical lenses and mirrors by polarizing the laser beams L with a polygon mirror 41 rotated by a motor. Alternatively, a system that performs optical scanning by a LED array can be employed as the optical write unit 40.

A first paper feed cassette 151 and a second paper feed cassette 152 that overlap each other in a perpendicular direction are disposed below the optical write unit 40. In each paper feed cassette, a plurality of recording media P are stacked and stored. The topmost recording medium P in the first paper feed cassette 151 is in contact with a first paper feed roller 151*a* and the topmost recording medium P in the second paper feed cassette 152 is in contact with a second paper feed roller 152*a*. When the first paper feed roller 151*a* is rotated anticlockwise in FIG. 2 by driving means not illustrated in the drawing, the topmost recording medium P in the first paper feed cassette 151 is ejected toward a feed path 153 disposed on the right hand side of the cassette in FIG. 2 so as to extend in the perpendicular direction. When the second paper feed roller 152*a* is rotated anticlockwise in FIG. 2 by driving means not illustrated in the drawing, the topmost recording medium P in the second paper feed cassette 152 is ejected toward the feed path 153.

Plural transport roller pairs 154 are disposed in the feed path 153. The recording medium P fed to the feed path 153 is sandwiched between the rollers of the transport roller pairs 154 and transported in the feed path 153 from the lower side toward the upper side of FIG. 2.

A resist roller pair 55 is disposed at a downstream end of the feed path 153 in the transporting direction. The resist roller pair 55 temporarily stops rotation of the rollers as soon as the recording medium P sent from the transport roller pairs 154 is placed between the rollers. Then the resist roller pair 55 feeds the recording medium P at an appropriate timing toward a secondary transfer nip described below.

Figure 3:
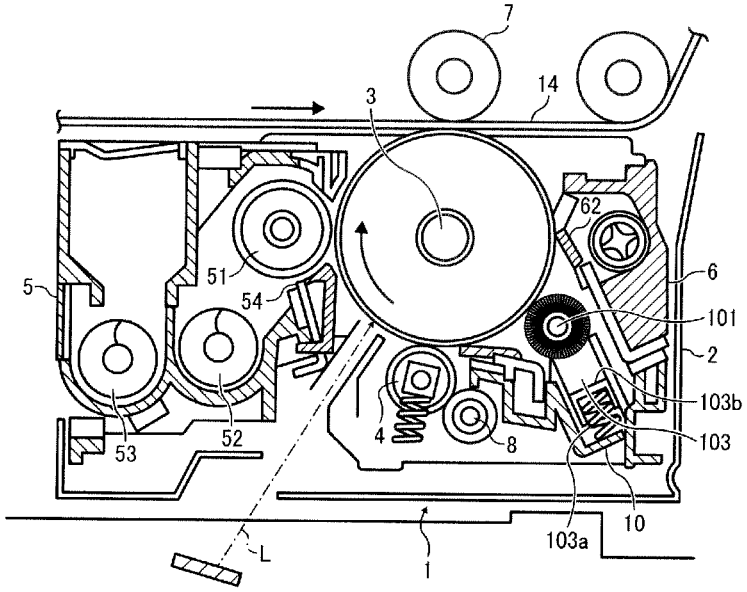
FIG. 3 is a schematic diagram illustrating an image forming unit of the example of the image forming apparatus.

FIG. 3 is a diagram illustrating a schematic structure of one of the image forming units 1Y, 1C, 1M and 1K illustrated in FIG. 2. This one image forming unit is referred to as the "image forming unit 1".

Referring to FIG. 3, the image forming unit 1 includes a drum-shaped photosensitive member 3 serving as an image carrier. Although the photosensitive member 3 in the drawing has a drum shape, the photosensitive member 3 may have a sheet shape or an endless belt shape.

A charge roller 4, a developing device 5, a primary transfer roller 7, a cleaning device 6, a lubricant coater 10, and a charge erasing lamp not illustrated in the drawing are disposed around the photosensitive member 3. The charge roller 4 is a charging member of a charging device serving as charging means. The developing device 5 is a developing means for forming a toner image from a latent image formed on the surface of the photosensitive member 3. The primary transfer roller 7 is a primary transfer member of a primary transfer device serving as primary transfer means for transferring a toner image on the surface of the photosensitive member 3 onto the intermediate transfer belt 14. The cleaning device 6 is cleaning means for cleaning the toner remaining on the photosensitive member 3 after the transfer of the toner image onto the intermediate transfer belt 14. The lubricant coater 10 is lubricant applying means for applying a lubricant to the surface of the photosensitive member 3 after cleaning with the cleaning device 6. The charge erasing lamp not illustrated in the drawing is charge erasing means for erasing the surface charges of the photosensitive member 3 after cleaning.

The charge roller 4 is disposed in a noncontact manner with a particular distance from the photosensitive member 3 and configured to charge the photosensitive member 3 to a particular polarity and a particular potential. The surface of the photosensitive member 3 uniformly charged by the charge roller 4 is illuminated with a laser beam L based on image data from the optical write unit 40 serving as latent image forming means so as to form an electrostatic latent image on the surface of the photosensitive member 3.

The developing device 5 includes a developing roller 51 serving as a developing agent carrier. A development bias is applied to the developing roller 51 from a power supply not illustrated in the drawing. A feed screw 52 and a stirring screw 53 are disposed in a casing of the developing device 5. The feed screw 52 and the stirring screw 53 are configured to transport the developing agent in the casing in directions opposite to each other so as to conduct stirring. A doctor 54 for regulating the developing agent carried on the developing roller 51 is also provided. The toner in the developing agent stirred and transported by the two screws, namely, the feed screw 52 and the stirring screw 53, is charged to a particular polarity. The developing agent is then lifted on the surface of the developing roller 51 and regulated by the doctor 54. As a result, the toner adheres to the latent image on the photosensitive member 3 in a development region opposing the photosensitive member 3.

The cleaning device 6 includes a cleaning blade 62 and other associated parts. The cleaning blade 62 makes contact with the photosensitive member 3 in a counter direction relative to the moving direction of the surface of the photosensitive member 3. The detailed account of the cleaning blade 62 is given below.

The lubricant coater 10 includes a solid lubricant 103, a lubricant pressurizing spring 103*a*, and other associated parts. The lubricant coater 10 uses a fur brush 101 as an application brush used to apply the solid lubricant 103 to the photosensitive member 3. The solid lubricant 103 is retained in a bracket 103*b* and pressurized toward the fur brush 101 by the lubricant pressurizing spring 103*a*. The solid lubricant 103 is scraped by the fur brush 101 rotating in the dragging direction relative to the rotation direction of the photosensitive member 3 and the lubricant is applied to the photosensitive member 3. Since the lubricant is applied to the photosensitive member 3, the coefficient of friction of the surface of the photosensitive member 3 is maintained to be 0.2 or less at the time when image forming is not being performed.

The charging device is a noncontact, closely spaced device in which the charge roller 4 is disposed closed to the photosensitive member 3. The charging device may employ a known structure such as corotron, scorotron, a solid state charger, or the like. Among these charging systems, a contact charging system or a noncontact, closely spaced system is more preferable since the charging efficiency is high, less ozone is generated, and the size of the device can be reduced.

Examples of the light source for the laser beam L of the optical write unit 40 and the light source of the charge erasing lamp or the like include all types of light-emitting devices such as fluorescent lamps, tungsten lamps, halogen lamps, mercury lamps, sodium lamps, light-emitting diodes (LEDs), semiconductor lasers (LDs), and electroluminescence (EL) devices.

In order to apply light of a desired wavelength region only, various types of filters such as a sharp cut filter, a band pass filter, an infrared cut filter, a dichroic filter, an interference filter, and a color conversion filter can be used.

Among these light sources, a light-emitting diode and a semiconductor laser are preferable since they have high illumination energy and emit long-wavelength light of 600 nm to 800 nm.

The transfer unit 60 illustrated in FIG. 2 and serving as transfer means includes, in addition to the intermediate transfer belt 14, a belt cleaning unit 162, a first bracket 63, and a second bracket 64. The transfer unit 60 also includes four primary transfer rollers 7Y, 7C, 7M, and 7K, a secondary transfer backup roller 66, a drive roller 67, an assisting roller 68, and a tension roller 69. The intermediate transfer belt 14 is stretched across these eight roller members and driven by the rotation of the drive roller 67 anticlockwise in FIG. 2 so as to perform endless move. The primary transfer rollers 7Y, 7C, 7M, and 7K and the photosensitive members 3Y, 3C, 3M, and 3K sandwich the endlessly moving intermediate transfer belt 14 so as to form primary transfer nips. A transfer bias having a polarity (for example, a positive polarity) opposite to that of the toner is applied to the back surface (loop inner peripheral surface) of the intermediate transfer belt 14. As the intermediate transfer belt 14 is endlessly moved and sequentially passes the first transfer nips for Y, C, M, and K, the Y, C, M and K toner images on the photosensitive members 3Y, 3C, 3M, and 3K are transferred (primary transfer) onto the front surface of the intermediate transfer belt 14 in a superimposed manner. As a result, a toner image constituted by superimposed images of four colors (hereinafter this image may be referred to as a four-color toner image) is formed on the intermediate transfer belt 14.

The secondary transfer backup roller 66 and a secondary transfer roller 70 disposed on the outer side of the loop of the intermediate transfer belt 14 sandwich the intermediate transfer belt 14 and form a secondary transfer nip. The resist roller pair 55 described above sends the recording medium P sandwiched between the rollers toward the secondary transfer nip at a timing that can be synchronized with the four-color toner image on the intermediate transfer belt 14. The entire four-color toner image on the intermediate transfer belt 14 is transferred (secondary transfer) onto the recording medium P in the secondary transfer nip due to the secondary transfer electric field formed between the secondary transfer roller 70 to which the secondary transfer bias is applied and the secondary transfer backup roller 66 and due to the influence of the nip pressure. As a result, a full-color toner image is formed including white from the recording medium P.

The transfer residual toner, which had not been transferred onto the recording medium P, remains attached to the intermediate transfer belt 14 that has passed the secondary transfer nip. The toner is removed with the belt cleaning unit 162. The belt cleaning unit 162 has a belt cleaning blade 162*a* in contact with the front surface of the intermediate transfer belt 14 and the transfer residual toner on the intermediate transfer belt 14 is scraped off and removed by the belt cleaning blade 162*a*.

The first bracket 63 of the transfer unit 60 is designed to swing at a particular rotational angle about the rotation axis line of the assisting roller 68 as the driving of a solenoid not illustrated in the drawing is turned ON and OFF. The image forming apparatus 500 forming a monochrome image turns the first bracket 63 anticlockwise in FIG. 2 by a small amount by driving the solenoid. Due to this rotation, the primary transfer rollers 7Y, 7C, and 7M for Y, C, and M are revolved anticlockwise in FIG. 2 about the rotation axis line of the assisting roller 68 so as to detach the intermediate transfer belt 14 from the photosensitive members 3Y, 3C, and 3M for Y, C, and M. Then only the image forming unit 1K among the four image forming units 1Y, 1C, 1M and 1K is driven to form a monochrome image. Accordingly, it becomes possible to avoid wear of components constituting the image forming units 1Y, 1C, and 1M for Y, C, and M since these units are not driven during formation of a monochrome image.

A fixing unit 80 is disposed above the secondary transfer nip in FIG. 2. The fixing unit 80 includes a pressurizing and heating roller 81 that contains a heat source such as a halogen lamp and a fixing belt unit 82. The fixing belt unit 82 includes a fixing belt 84 serving as a fixing member, a heating roller 83 that contains a heat source such as a halogen lamp, a tension roller 85, a drive roller 86, a temperature sensor not illustrated in the drawing, and other associated parts. The fixing belt 84 is of an endless type, is stretched across the heating roller 83, the tension roller 85, and the drive roller 86, and is moved endlessly in the anticlockwise direction in FIG. 2. During the course of the endless movement, the fixing belt 84 is heated from the back side by the heating roller 83. The pressurizing and heating roller 81 rotated anticlockwise in FIG. 2 contacts the front surface of the heated fixing belt 84 at a portion supported by the heating roller 83 from the back. As a result, a fixing nip is formed at a portion where the pressurizing and heating roller 81 and the fixing belt 84 contact each other.

A temperature sensor not illustrated in the drawing is disposed on the outer side of the loop of the fixing belt 84 so as to oppose the front surface of the fixing belt 84 with a particular gap therebetween. The temperature sensor detects the surface temperature of the fixing belt 84 immediately before entering the fixing nip. The detection result is sent to a fixing power supply circuit not illustrated in the drawing. Based on the detection results of the temperature sensor, the fixing power supply circuit controls ON and OFF of the power supplied to the heat source in the heating roller 83 and the heat source in the pressurizing and heating roller 81.

The recording medium P that has passed through the secondary transfer nip is detached from the intermediate transfer belt 14 and sent to the fixing unit 80. As the recording medium P is transported upward in FIG. 2 while being sandwiched in the fixing nip in the fixing unit 80, the recording medium P is heated and pressurized by the fixing belt 84. As a result, the full-color toner image is fixed onto the recording medium P.

The recording medium P subjected to this fixing treatment travels between the rollers of a sheet ejection roller pair 87 and is discharged from the apparatus. A stack portion 88 is formed on the upper surface of a casing of the main body of the image forming apparatus 500. The recording medium P discharged by the sheet ejection roller pair 87 is sequentially stacked on the stack portion 88.

Four toner cartridges 100Y, 100C, 100M, and 100K respectively containing Y, C, M, and K toners are disposed above the transfer unit 60. The Y, C, M, and K toners in the toner cartridges 100Y, 100C, 100M, and 100K are supplied to developing devices 5Y, 5C, 5M, and 5K of the image forming units 1Y, 1C, 1M and 1K as needed. These toner cartridges 100Y, 100C, 100M, and 100K are independent from the image forming units 1Y, 1C, 1M and 1K and are detachable from the main body of the image forming apparatus.

Next, image forming operation carried out in the image forming apparatus 500 illustrated in FIG. 2 is described.

First, a signal to perform printing is sent from an operation section or the like not illustrated in the drawing, and a predetermined voltage or current is applied to the charge roller 4 and the developing roller 51 at a predetermined timing based on this signal. Similarly, a predetermined voltage or current is applied to the optical write unit 40 and light sources such as a charge erasing lamp at a predetermined timing. In synchronization with this operation, the photosensitive members 3Y, 3C, 3M, and 3K are driven and rotated in the arrow direction of FIG. 2 by a photosensitive member drive motor (not illustrated in the drawing) serving as driving means.

As the photosensitive members 3Y, 3C, 3M, and 3K are rotated in the arrow direction in FIG. 2, the surfaces of the photosensitive members 3Y, 3C. 3M, and 3K are uniformly charged to a predetermined potential by the charge rollers 4. Laser beams L corresponding to image data are applied from the optical write unit 40 to the photosensitive members 3Y, 3C, 3M, and 3K. The charges in the portion irradiated with the laser beam L on the surface of each photosensitive member are erased and an electrostatic latent image is formed as a result.

The surfaces of the photosensitive members 3Y, 3C, 3M, and 3K on which electrostatic latent images have been formed are each rubbed with a magnetic brush of the developing agent formed on the developing roller 51 at a portion opposing the developing device 5. During this process, the negatively charged toner on the developing roller 51 is caused to migrate to the electrostatic latent image by a predetermined development bias applied to the developing roller 51 and a toner image is formed (developed) as a result. In each of the image forming units 1Y, 1C, 1M and 1K, the same image forming process is executed and toner images of respective colors are respectively formed on the surfaces of the photosensitive members 3Y, 3C, 3M, and 3K of the image forming units 1Y, 1C, 1M and 1K.

As discussed above, in the image forming apparatus 500, electrostatic latent images formed on the photosensitive members 3Y, 3C, 3M, and 3K are reversed and developed by the developing devices 5 with a negatively charged toner. In this embodiment, an example in which a negative/positive (N/P, toner attaching to a portion having a lower potential) noncontact charging roller system is used is described. However, the system is not limited to this.

The toner images of respective colors formed on the surfaces of the photosensitive members 3Y, 3C, 3M, and 3K are sequentially subjected to primary transfer so that the toner images are superimposed on one another on the surface of the intermediate transfer belt 14. As a result, a four-color toner image is formed on the intermediate transfer belt 14.

The four-color toner image formed on the intermediate transfer belt 14 is transferred onto the recording medium P fed from the first paper feed cassette 151 or second paper feed cassette 152, passed between the rollers of the resist roller pair 55, and reached the secondary transfer nip. During this process, the recording medium P temporarily stops while being sandwiched in the resist roller pair 55, and supplied to the secondary transfer nip in a manner synchronous with the front end of the image on the intermediate transfer belt 14. The recording medium P onto which the toner image has been transferred is detached from the intermediate transfer belt 14 and transported to the fixing unit 80. As the recording medium P onto which the toner image has been transferred passes through the fixing unit 80, the toner image is fixed to the recording medium P by heat and pressure. The recording medium P with the toner image fixed thereon is discharged outside the image forming apparatus 500 and stacked on the stack portion 88.

The surface of the intermediate transfer belt 14 from which the toner image has been transferred onto the recording medium P at the secondary transfer nip is cleaned by the belt cleaning unit 162 to remove the transfer residual toner on the surface.

The surfaces of the photosensitive members 3Y, 3C, 3M, and 3K from which the toner images of respective colors have been transferred onto the intermediate transfer belt 14 at the primary transfer nip are cleaned by the cleaning device 6 to remove the residual toner after transfer. A lubricant is applied to the surfaces by the lubricant coater 10 and then charges are erased with the charge erasing lamp.

Referring to FIG. 3, the image forming unit 1 of the image forming apparatus 500 includes a photosensitive member 3, and a charge roller 4, a developing device 5, a cleaning device 6, a lubricant coater 10, and other associated parts serving as processing means, housed in a frame 2. The entire image forming unit 1 is configured as a process cartridge and is detachable from the main body of the image forming apparatus 500. In the image forming apparatus 500, the image forming unit 1 is designed as a process cartridge so that the photosensitive member 3 and the processing means can be replaced together. Alternatively, the unit parts, such as the photosensitive member 3, the charge roller 4, the developing device 5, the cleaning device 6, and the lubricant coater 10, may each be designed to be replaceable.

The toner used in the image forming apparatus 500 is preferably a polymerized toner prepared by suspension polymerization, emulsion polymerization, or dispersion polymerization since the toner can be made highly circular with a reduced diameter and the image quality can be improved. In particular, a polymerized toner having an average circularity of 0.97 or higher and a volume-average particle diameter of 5.5 μm or less is preferably used from the viewpoint of forming high-definition images.

Figure 1B:
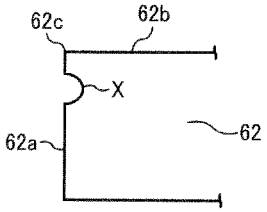
FIG. 1B is a diagram illustrating local wear at a tip surface of a typical cleaning blade.
Figure 1C:
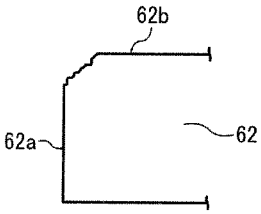
FIG. 1C is a diagram illustrating a missing portion of a contact portion of a typical cleaning blade.

The polymerized toner having high circularity and small diameter cannot be satisfactorily removed from the surface of the photosensitive member 3 by using the cleaning blade 62 in a manner similar to removal of a typical pulverized toner from the surface of the photosensitive member 3, resulting in cleaning failure. Increasing the pressure of contact of the cleaning blade 62 onto the photosensitive member 3 may enhance the cleaning property but accelerates wear of the cleaning blade 62. Moreover, the frictional force between the cleaning blade 62 and the photosensitive member 3 is increased, the contact portion (tip ridge) 62*c* of the cleaning blade 62 in contact with the photosensitive member 3 is pulled in the moving direction of the photosensitive member 3 and becomes bent back (refer to FIGS. 1A to 1C). Bending back of the contact portion 62*c* of the cleaning blade 62 causes various problems such as noise, vibrations, and a missing portion in the contact portion.

Figure 4:
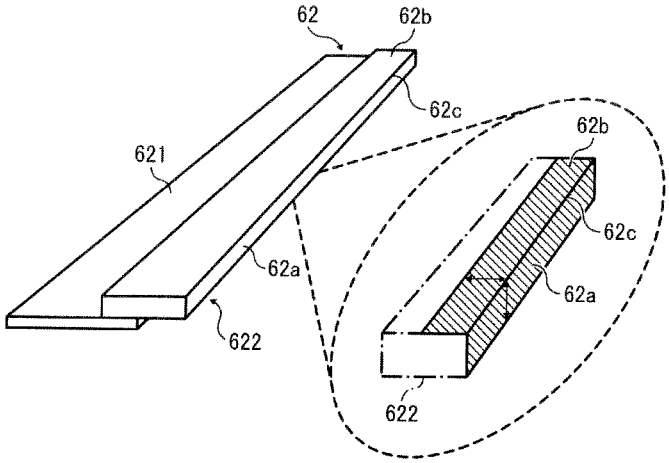
FIG. 4 is a perspective view illustrating one example of a cleaning blade according to an embodiment of the present invention.
Figure 5A:
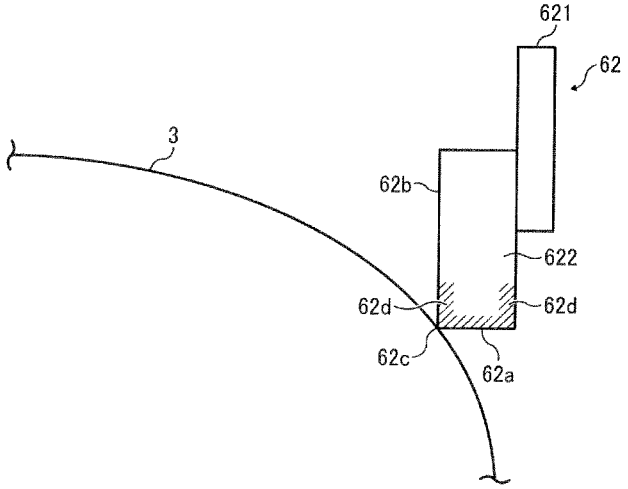
FIG. 5A is an enlarged cross-sectional view illustrating a cleaning blade making contact with a surface of an image carrier.
Figure 5B:
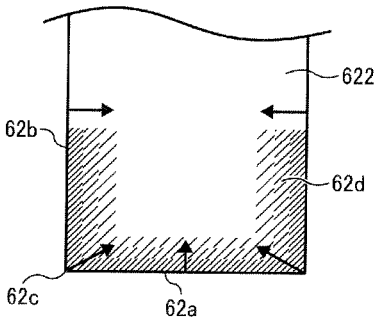
FIG. 5B is an enlarged view of the cleaning blade and a portion near the cleaning blade.

FIG. 4 is a perspective view of the cleaning blade 62. FIGS. 5A and 5B are enlarged cross-sectional views of the cleaning blade 62. FIG. 5A illustrates a state of the cleaning blade 62 making contact with the surface of the photosensitive member 3. FIG. 5B is an enlarged view of the contact portion (tip ridge) 62*c* of the cleaning blade 62 and the vicinity of the contact portion.

As illustrated in FIG. 4, the cleaning blade 62 includes a plate-shape supporting member 621 composed of a rigid material such as metal or a hard plastic, and an elastic member 622 having a plate shape. The elastic member 622 is fixed to one end of the supporting member 621 with an adhesive or the like. The other end of the supporting member 621 is cantilevered by the casing of the cleaning device 6.

As illustrated in FIG. 5A, the cleaning blade 62 is constituted by the supporting member 621 and the elastic member 622 having a plate shape and having one end connected to the supporting member 621 and a free end portion of a particular length at the other end. The contact portion 62*c* is the free-end-side end of the elastic member 622 and is arranged to contact the surface of the photosensitive member 3 along the longitudinal direction.

The elastic member 622 preferably has high rebound resilience in order to follow the eccentricity of the photosensitive member 3 and fine undulations on the surface of the photosensitive member 3. Polyurethane rubber or the like is preferable. The JIS-A hardness of the elastic member is preferably 60 or higher. The rebound resilience of the elastic member according to the JIS K 6255 standard is preferably 35% or less at 23° C. The contact portion 62*c* of the elastic member 622 contacting the surface of the image carrier contains a cured product of an UV-curable composition that contains a (meth)acrylate compound (in particular, a (meth) acrylate compound having a tricyclodecane structure or a (meth)acrylate compound having an adamantane structure, pentaerythritol triacrylate, and a dipentaerythritol hexaacrylate are preferable).

The UV curable composition containing a (meth)acrylate compound is allowed to penetrate the contact portion of the elastic member and then irradiated with UV light. As a result, a penetrated portion 62*d* illustrated in FIG. 5B is formed, the hardness of the contact portion 62*c* is increased, the durability is improved, and deformation of the elastic member in the direction of the movement of the surface of the photosensitive member 3 can be suppressed. Moreover, deformation can be suppressed by the penetrated portion 62*d* when the interior is exposed by wear of the surface layer over time.

Figure 8A:
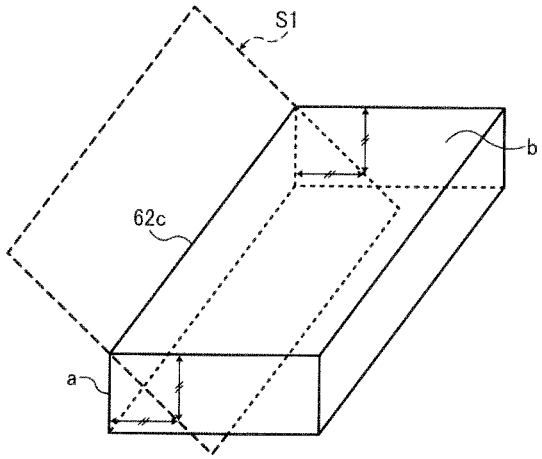
FIG. 8A is a diagram used to describe a plane that lies at an equal distance from two surfaces constituting the contact portion in a cleaning blade according to an embodiment of the present invention.
Figure 8B:
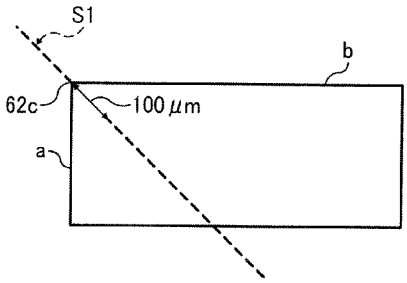
FIG. 8B is a diagram used to describe a modified portion that extends 100 μm from the contact portion in the contact portion thickness inward direction on the plane that lies at an equal distance from the two surfaces constituting the contact portion of the cleaning blade according to the present invention.

FIGS. 8A and 8B are diagrams illustrating a modified portion "extending 100 μm in the contact portion thickness inward direction from the contact portion on a plane that lies at an equal distance from two surfaces constituting the contact portion".

In FIG. 8A, the broken line S1 indicates a plane (imaginary plane) that lies at an equal distance from a surface a and a surface b constituting the contact portion. The double-headed arrow on the broken line in FIG. 8B indicates the modified portion that extends 100 μm in the contact portion thickness direction on the imaginary plane.

S1 in FIGS. 8A and 8B denotes the plane that lies at an equal distant from the two surfaces constituting the contact portion.

In the present invention, the value of a peak area ratio $S_A/S_B$ normalized by a peak area ratio $S_A'/S_B'$, namely, $(S_A/S_B))/(S_A/S_B')$, is 1.5 or more and 10 or less where $S_A$ is a peak area value at 1162 $cm^{-1}$ and $S_B$ is a peak area value at 1533 $cm^{-1}$ obtained in infrared microspectrometry at the position of the double-headed arrow, and $S_A'/S_B'$ is the peak area ratio in a portion outside the modified layer.

(Process Cartridge)

A process cartridge according to the present invention includes at least an image carrier and cleaning means for removing a toner remaining on the image carrier, and may further include other means if needed.

An example of the cleaning means is the cleaning blade described above.

The process cartridge is a device (component) that is detachably attachable to an image forming apparatus and includes an image carrier, the cleaning blade of the present invention described above, and at least one means selected from charging means, exposing means, developing means, transferring means, cleaning means, and charge erasing means.

EXAMPLES

Examples of the present invention will now be described. These examples do not limit the scope of the present invention.

<Normalized Peak Area Ratio of the Cleaning Blade Modified Portion>

The normalized peak area ratio of the cleaning blade modified portion was measured by a transmission method using FT/IR-6200 (with IRT-7000) produced by JASCO Corporation. The measured region was any point in the modified portion extending 100 μm from the contact portion in the contact portion thickness inward direction on the plane that lies at an equal distance from two surfaces constituting the contact portion. The peak area was calculated by using the bundled software. The peak area of the portion outside the modified layer is obtained from a spectrum measured at a desired point of the elastic member in the region not penetrated by the acrylate compound, the region being on the inner side of the contact portion.

<JIS-A Hardness of Elastic Member>

The JIS-A hardness of the elastic member was measured according to JIS K 6253 by using a micro durometer MD-1 KOBUNSHI KEIKI CO., LTD. For an elastic member having a two-layer structure, measurement was performed at each surface.

<Rebound Resilience of Elastic Member>

The rebound resilience of the elastic member was measured according to JIS K 6255 by using No. 221 resilience tester produced by Toyo Seiki Seisaku-Sho, Ltd. The measurement specimen was a specimen prepared by stacking sheets each about 2 mm in thickness so that the total thickness was 4 mm or more.

<Average Circularity of Toner>

Figure 6A:
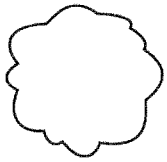
FIG. 6A is a diagram used to describe a method for measuring an average circularity of a toner.
Figure 6B:
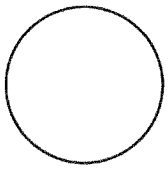
FIG. 6B is a diagram used to describe the method for measuring an average circularly of a toner.

The average circularity of the toner was measured with a flow particle image analyzer (FPIA-2000 produced by Sysmex Corporation). In particular, into 100 mL to 150 mL of water from which impurity solid matter in the container had been removed in advance, 0.1 mL to 0.5 mL of a surfactant (alkyl benzene sulfonic acid salt) was added as a dispersant and then about 0.1 g to 0.5 g of the measurement specimen (toner) was added thereto. Subsequently, the suspension in which the toner had been dispersed was dispersed with an ultrasonic disperser for 1 to 3 minutes to prepare a dispersion having a density of 3,000 particles/μL to 10,000 particles/μL. The dispersion was loaded in the analyzer and the shape and distribution of the toner were measured. Based on the measurement results, C2/C1 was determined where C1 represents an external peripheral length of an actual toner projection image having an area S illustrated in FIG. 6A and C2 is an external peripheral length of a circle having the same projection area S illustrated in FIG. 6B. The average was taken and assumed to be the average circularity.

<Volume-Average Particle Diameter of Toner>

The volume-average particle diameter of the toner was determined by a Coulter counter method. In particular, a Coulter Multisizer 2e (produced by Beckman Coulter Inc.) was used to obtain data related to the number distribution and the volume distribution of the toner and the data was sent to a personal computer via an interface (produced by Nikkaki Co., Ltd.) to conduct analysis. To be more specific, a 1 mass % NaCl aqueous solution using a first grade sodium chloride was prepared as an electrolyte. Into 100 mL to 150 mL of this electrolyte aqueous solution, 0.1 mL to 5 mL of a surfactant (alkyl benzene sulfonic acid salt) was added as a dispersant. Thereto, 2 mg to 20 mg of a toner serving as a test specimen was added and dispersed with an ultrasonic disperser for 1 to 3 minutes. In a separate beaker, 100 mL to 200 mL of the electrolyte aqueous solution was placed and the solution after the dispersion treatment was added to the beaker until the concentration reached a particular value. The resulting mixture was then processed with a Coulter Multisizer 2e.

The diameters of 50,000 toner particles were measured by using a 100 μm aperture and thirteen channels, namely, 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm. The toner particles with a diameter of 2.00 μm or more and 32.0 μm or less were subject to the measurement.

The volume-average particle diameter was then calculated from the relationship Volume-average particle size=$\Sigma XfV/\Sigma fV$ where X is a representative diameter of each channel, V is an equivalent volume at the representative diameter of each channel, and f is the number of particles in each channel.

Production Example 1

Preparation of Elastic Member 1

A 11.5 mm×32.6 mm plate-shaped elastic member 1 having an average thickness of 1.8 mm was prepared by referring to a method for making a cleaning blade disclosed in Reference Examples of JP-2011-141449-A.

The JIS-A hardness of the resulting elastic member 1 was 68 and the rebound resilience was 30%.

Production Example 2

Preparation of Elastic Member 2

A 11.5 mm×32.6 mm plate-shape, two-layer elastic member 2 having an average thickness of 1.8 mm was prepared by referring to a method for making a cleaning blade disclosed in Example 1 of JP-2011-141449-A.

The JIS-A hardness of the resulting two-layer elastic member 2 was 80 at the contact surface side and 75 at the opposite side. The rebound resilience was 25%.

Preparation Example 1

Preparation of UV Curable Composition 1

AN UV curable composition 1 was prepared by a common method from the composition described below:

| | |
|---|---|
| Tricyclodecane dimethanol diacrylate represented by the following structural formula (trade name: A-DCP produced by Shin-Nakamura Chemical Co., Ltd., number of functional groups: 2, molecular weight: 304): | 50 parts by mass |

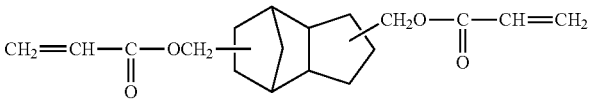

| | |
|---|---|
| Polymerization initiator (IRGACURE 184 produced by Ciba Specialty Chemicals) | 5 parts by mass |
| Solvent (cyclohexanone) | 55 parts by mass |

Preparation Example 2

Preparation of UV Curable Composition 2

AN UV curable composition 2 was prepared by a common method from the composition described below:

| | |
|---|---|
| (Meth)acrylate compound 1 having an adamantane structure represented by the following structural formula (X-DA produced by Idemitsu Kosan Co., Ltd., number of functional groups: 2, molecular weight: 276 to 304, reaction product between 1,3-adamantanediol and acrylic acid) | 50 parts by mass |
| 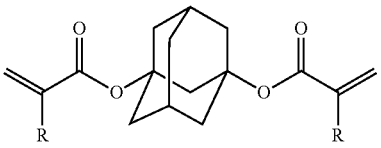 (R = H, $CH_3$) | |
| In the formula, R represents a hydrogen atom or a methyl group. | |
| Polymerization initiator (IRGACURE 184 produced by Ciba Specialty Chemicals) | 5 parts by mass |
| Solvent (cyclohexanone) | 55 parts by mass |

Preparation Example 3

Preparation of UV Curable Composition 3

AN UV curable composition 3 was prepared by a common method from the composition described below:

| | |
|---|---|
| (Meth)acrylate compound 2 having an adamantane structure represented by the following structural formula (1,3-adamantane dimethanol diacrylate X-A-201 produced by Idemitsu Kosan Co., Ltd., number of functional groups: 2, molecular weight: 304) | 50 parts by mass |
| 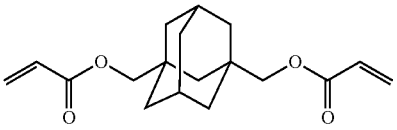 | |
| Polymerization initiator (IRGACURE 184 produced by Ciba Specialty Chemicals) | 5 parts by mass |
| Solvent (cyclohexanone) | 55 parts by mass |

Preparation Example 4

Preparation of UV Curable Composition 4

AN UV curable composition 4 was prepared by a common method from the composition described below:

| | |
|---|---|
| (Meth)acrylate compound 3 having an adamantane structure represented by the following structural formula (DIAPURESTE ADTM produced by Mitsubishi Gas Chemical Company, Inc., number of functional groups: 3, molecular weight: 388) | 50 parts by mass |

-continued

| | |
|---|---|
| 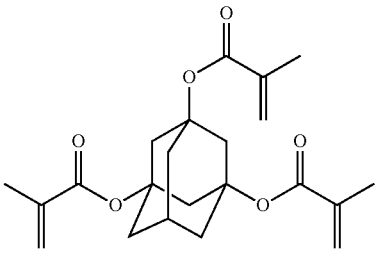 | |
| Polymerization initiator (IRGACURE 184 produced by Ciba Specialty Chemicals) | 5 parts by mass |
| Solvent (cyclohexanone) | 55 parts by mass |

Preparation Example 5

Preparation of UV Curable Composition 5

AN UV curable composition 5 was prepared by a common method from the composition described below:

| | |
|---|---|
| Tricyclodecane dimethanol diacrylate used in Preparation Example 1 (A-DCP produced by Shin-Nakamura Chemical Co., Ltd., number of functional groups: 2, molecular weight: 304) | 25 parts by mass |
| Pentaerythritol triacrylate represented by the following structural formula (PETIA produced by Daicel Cytec Company Ltd., number of functional groups: 3, molecular weight: 298) | 25 parts by mass |
| 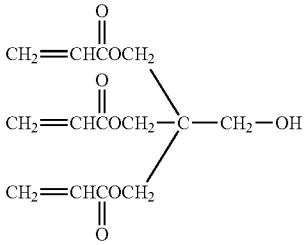 | |
| Polymerization initiator (IRGACURE 184 produced by Ciba Specialty Chemicals) | 5 parts by mass |
| Solvent (cyclohexanone) | 55 parts by mass |

Preparation Example 6

Preparation of UV Curable Composition 6

AN UV curable composition 6 was prepared by a common method from the composition described below:

| | |
|---|---|
| (Meth)acrylate compound 2 having an adamantane structure used in Preparation Example 3 (1,3-adamantane dimethanol diacrylate X-A-201 produced by Idemitsu Kosan Co., Ltd., number of functional groups: 2, molecular weight: 304) | 25 parts by mass |
| Pentaerythritol triacrylate used in Preparation Example 5 (PETIA produced by Daicel Cytec Company Ltd., number of functional groups: 3, molecular weight: 298) | 25 parts by mass |

-continued

| | |
|---|---|
| Polymerization initiator (IRGACURE 184 produced by Ciba Specialty Chemicals) | 5 parts by mass |
| Solvent (cyclohexanone) | 55 parts by mass |

Preparation Example 7

Preparation of UV Curable Composition 7

AN UV curable composition 7 was prepared by a common method from the composition described below:

| | |
|---|---|
| Pentaerythritol triacrylate used in Preparation Example 5 (PETIA produced by Daicel Cytec Company Ltd., number of functional groups: 3, molecular weight: 298) | 50 parts by mass |
| Polymerization initiator (IRGACURE 184 produced by Ciba Specialty Chemicals) | 5 parts by mass |
| Solvent (cyclohexanone) | 55 parts by mass |

Preparation Example 8

Preparation of UV Curable Composition 8

AN UV curable composition 8 was prepared by a common method from the composition described below:

| | |
|---|---|
| Dipentaerythritol hexaacrylate (DPHA produced by Daicel Cytec Company Ltd., number of functional groups: 6, molecular weight: 578) | 59 parts by mass |

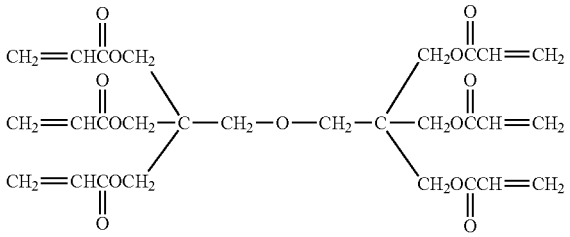

| | |
|---|---|
| Polymerization initiator (IRGACURE 184 produced by Ciba Specialty Chemicals) | 5 parts by mass |
| Solvent (cyclohexanone) | 55 parts by mass |

Production Example of Toner

Toner base particles having an average circularity of 0.98 and a volume-average particle diameter of 4.9 μm were prepared by a polymerization method. To 100 parts by mass of the toner base particles, 1.5 parts by mass of small-diameter silica fine particles (H2000 produced by Clariant), 0.5 part by mass of small-diameter titanium oxide fine particles (MT-150AI produced by Tayca), and large-diameter silica fine particles (UFP-30H produced by Denki Kagaku Kogyo Kabushiki Kaisha) were added and the resulting mixture was stirred and mixed to prepare a toner.

Example 1

Preparation of Cleaning Blade 1

In a liquid prepared by diluting the UV curable composition 1 with a diluent (cyclohexanone) to a solid content of 50% by mass, a portion up to 2 mm from the tip of the elastic member 1 on the side that comes into contact with an image carrier was immersed for 2 hours and dried in air for 3 minutes. After air drying, UV light was applied (140 W/cm×5 m/min×5 passes) by using an UV irradiation device (UVC-2534/1MNLC3 produced by Ushio Inc.). Then drying was performed for 15 minutes in a heat dryer at a temperature of 100° C. inside.

Next, the elastic member 1 after the surface curing treatment was fixed to a plate holder serving as a supporting member. As a result, a cleaning blade 1 was obtained.

Next, the cleaning blade 1 was loaded in a color multifunctional printer (imagio MP C5001 produced by Ricoh Company) at predetermined tip entry amount (linear pressure) and installation angle. The linear pressure and installation angle differ depending on the sample type of the cleaning blade.

The toner was loaded in the color multifunctional printer (imagio MP C5001 produced by Ricoh Company). In an environment at 21° C. and 65% RH, a chart (A4 size, landscape orientation) having an image area ratio of 5% was printed on 10,000 sheets at 3 prints/job. Then the amount of bent-back at the contact portion, the cleaning property, and the amount of wear at the contact portion were evaluated as below. The results are indicated in Table 3.

<Amount of Bent-Back Portion of Contact Portion>

The state of the cleaning blade coming into contact with a glass plate to which a material used for the photosensitive member surface layer had been applied was observed from the back of the glass plate. The cleaning blade here was caused to rub the surface of the glass plate at a predetermined tip entry amount (linear pressure) and a predetermined installation angle. The length of the bent-back portion at the contact portion of the elastic member of the cleaning blade was measured by using an image output from a CCD camera (Nikon CM-5, produced by Nikon Corporation).

<Cleaning Property>

After the 10,000 sheets of output described above, a vertical strip pattern (with respect to the paper moving direction) 43 mm in width and the three-chart evaluation image (A4 in size, landscape orientation) were output on 20 sheets. The output images were observed with naked eye and the cleaning property was evaluated based on the following standard. Note that the "abnormal image" indicates that streaks or strips appeared in the printed images or that white spot images were observed.

[Evaluation Standard]

○: No abnormal image x: Abnormal image

<Wear Amount of Contact Portion>

Figure 7:
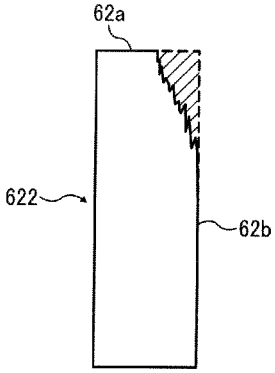
FIG. 7 is a diagram illustrating a method for measuring an amount of wear of a cleaning blade in Examples.

After the 10,000 sheets of the output described above, the wear width of the elastic member viewed from the tip surface side as illustrated in FIG. 7 was measured with Laser Microscope VK-9510 produced by Keyence Corporation and the result was assumed to be the wear amount of the contact portion. Note that the shaded part in FIG. 7 indicates the cross-sectional area of the worn portion.

Examples 2 to 6 and Comparative Examples 1 to 3

Preparation of Cleaning Blades 2 to 6 and 12 to 14

Cleaning blades 2 to 6 of Examples 2 to 6 and cleaning blades 12 to 14 of Comparative Examples 1 to 3 were prepared as in Example 1 except that the UV curable compositions indicated in Table 2 were used instead of the UV curable composition used in Example 1.

Each cleaning blade obtained was evaluated in terms of the amount of bent-back of the contact portion, the cleaning property, and the wear amount of the contact portion as in Example 1. The results are indicated in Table 3.

Examples 7 and 8

Preparation of Cleaning Blades 7 and 8

Cleaning blades 7 and 8 of Examples 7 and 8 were prepared as in Example 1 except that the UV curable compositions indicated in Table 2 were used and that the penetration time was changed to 6 hours.

The resulting cleaning blades were evaluated in terms of the amount of bent-back of the contact portion, the cleaning property, and the wear amount of the contact portion as in Example 1. The results are indicated in Table 3.

Example 9

Preparation of Cleaning Blade 9

A cleaning blade 9 of Example 9 was prepared as in Example 1 except that the penetration time was changed to 6 hours.

The resulting cleaning blade was evaluated in terms of the amount of bent-back of the contact portion, the cleaning property, and the wear amount of the contact portion as in Example 1. The results are indicated in Table 3.

Examples 10 and 11

Preparation of Cleaning Blades 10 and 11

Cleaning blades 10 and 11 of Examples 10 and 11 were prepared as in Example 1 except that the elastic member 2 indicated in Table 1 and the UV curable compositions indicated in Table 2 were used. Note that the elastic member having a two-layer structure was prepared by bonding two types of rubber having different physical properties as described above and rubber having a higher hardness came at the contact portion (tip ridge) that contacted the image carrier.

Each cleaning blade was evaluated in terms of the amount of bent-back of the contact portion, the cleaning property, and the wear amount of the contact portion as in Example 1. The results are indicated in Table 3.

Comparative Example 4

Preparation of Cleaning Blade 15

A cleaning blade 15 of Comparative Example 4 was prepared as in Example 1 except that the penetration time was changed to 18 hours.

The resulting cleaning blade was evaluated in terms of the amount of bent-back of the contact portion, the cleaning property, and the wear amount of the contact portion as in Example 1. The results are indicated in Table 3.

TABLE 1

| | | Elastic member | | | |
|---|---|---|---|---|---|
| | Cleaning blade No. | No. | Structure | JIS-A hardness | Rebound resilience |
| Example 1 | Cleaning blade 1 | 1 | Single layer | 68 | 30% |
| Example 2 | Cleaning blade 2 | 1 | Single layer | 68 | 30% |
| Example 3 | Cleaning blade 3 | 1 | Single layer | 68 | 30% |
| Example 4 | Cleaning blade 4 | 1 | Single layer | 68 | 30% |
| Example 5 | Cleaning blade 5 | 1 | Single layer | 68 | 30% |
| Example 6 | Cleaning blade 6 | 1 | Single layer | 68 | 30% |
| Example 7 | Cleaning blade 7 | 1 | Single layer | 68 | 30% |
| Example 8 | Cleaning blade 8 | 1 | Single layer | 68 | 30% |
| Example 9 | Cleaning blade 9 | 1 | Single layer | 68 | 30% |
| Example 10 | Cleaning blade 10 | 2 | Two-layer | 80 + 75 | 25% |
| Example 11 | Cleaning blade 11 | 2 | Two-layer | 80 + 75 | 25% |
| Comparative Example 1 | Cleaning blade 12 | 1 | Single layer | 68 | 30% |
| Comparative Example 2 | Cleaning blade 13 | 1 | Single layer | 68 | 30% |
| Comparative Example 3 | Cleaning blade 14 | 1 | Single layer | 68 | 30% |
| Comparative Example 4 | Cleaning blade 15 | 1 | Single layer | 68 | 30% |

TABLE 2

| | UV curable composition | | | | |
|---|---|---|---|---|---|
| | No. | Polymerizable monomer 1 | Polymerizable monomer 2 | Polymerization initiator | Solvent |
| Example 1 | 1 | Tricyclodecane dimethanol diacrylate | — | IRGACURE 184 | Cyclohexanone |

TABLE 2-continued

| | UV curable composition | | | | |
|---|---|---|---|---|---|
| | No. | Polymerizable monomer 1 | Polymerizable monomer 2 | Polymerization initiator | Solvent |
| Example 2 | 2 | (Meth)acrylate compound 1 having adamantane structure | — | IRGACURE 184 | Cyclohexanone |
| Example 3 | 3 | (Meth)acrylate compound 2 having adamantane structure | — | IRGACURE 184 | Cyclohexanone |
| Example 4 | 4 | (Meth)acrylate compound 3 having adamantane structure | — | IRGAURE 184 | Cyclohexanone |
| Example 5 | 5 | Tricyclodecane dimethanol diacrylate | Pentaerythritol triacrylate | IRGACURE 184 | Cyclohexanone |
| Example 6 | 6 | (Meth)acrylate compound 2 having adamantane structure | Pentaerythritol triacrylate | IRGACURE 184 | Cyclohexanone |
| Example 7 | 7 | Pentaerythritol triacrylate | — | IRGACURE 184 | Cyclohexanone |
| Example 8 | 8 | Dipentaerythritol hexaacrylate | — | IRGACURE 184 | Cyclohexanone |
| Example 9 | 1 | Tricyclodecane dimethanol diacrylate | — | IRGACURE 184 | Cyclohexanone |
| Example 10 | 1 | Tricyclodecane dimethanol diacrylate | — | IRGACURE 184 | Cyclohexanone |
| Example 11 | 2 | (Meth)acrylate compound 1 having adamantane structure | — | IRGACURE 184 | Cyclohexanone |
| Comparative Example 1 | | | None | | |
| Comparative Example 2 | 7 | Pentaerythritol triacrylate | — | IRGACURE 184 | Cyclohexanone |
| Comparative Example 3 | 8 | Dipentaerythritol hexaacrylate | — | IRGACURE 184 | Cyclohexanone |
| Comparative Example 4 | 1 | Tricyclodecane dimethanol diacrylate | — | IRGACURE 184 | Cyclohexanone |

TABLE 3

| | Cleaning property | Bent-back amount (μm) | Wear amount (μm) | Normalized peak area ratio |
|---|---|---|---|---|
| Example 1 | ○ | 0 | 4 | 2.2 |
| Example 2 | ○ | 0 | 8 | 3.1 |
| Example 3 | ○ | 0 | 3 | 2.9 |
| Example 4 | ○ | 0 | 3 | 2.5 |
| Example 5 | ○ | 0 | 4 | 4.2 |
| Example 6 | ○ | 0 | 4 | 3.5 |
| Example 7 | ○ | 0 | 3 | 6.7 |
| Example 8 | ○ | 0 | 5 | 5.3 |
| Example 9 | ○ | 0 | 6 | 9.1 |
| Example 10 | ○ | 0 | 4 | 2.4 |
| Example 11 | ○ | 0 | 4 | 1.8 |
| Comparative Example 1 | X | 10 | Undetectable | Undetectable |
| Comparative Example 2 | X | 4 | Undetectable | 1.1 |
| Comparative Example 3 | X | 6 | Undetectable | 0.6 |
| Comparative Example 4 | X | 1 | Undetectable | 10.8 |

Examples 1 to 11 each include a modified layer containing a cured product of an UV curable composition containing a (meth)acrylate compound according to the present invention and satisfy the constitutional requirement that the value of a peak area ratio $S_A/S_B$ normalized by a peak area ratio $S_A'/S_B'$ in a portion other than the modified layer is 1.5 or more and 10 or less where $S_A$ is a peak area value at 1162 $cm^{-1}$ and $S_B$ is a peak area value at 1533 $cm^{-1}$ obtained in microspectrometry at the position in the modified portion that extends from the contact portion by 100 μm in the contact portion thickness inward direction on a plane that lies at an equal distant from two surfaces constituting the contact portion.

The results in Table 3 clarify that, in Examples 1 to 11, bending-back of the contact portion of the elastic member is suppressed, the wear of the contact portion of the elastic member is less during use, and a satisfactory cleaning property can be maintained over a long period of time.

The embodiments of the present invention are as follows:

<1>A cleaning blade including an elastic member configured to come into contact with a surface of a member to be cleaned and remove residual matter adhering to the surface of the member to be cleaned, the elastic member satisfying requirements a and b below:

a. The elastic member has a contact portion configured to come into contact with the surface of the member to be cleaned and the contact portion includes a modified layer that contains a cured product of an ultraviolet curable composition containing a (meth)acrylate compound; and b. A value obtained by normalizing a peak area ratio $S_A/S_B$ of a modified portion with a peak area ratio $S_A'/S_B'$ of a portion outside the modified layer is 1.5 or more and 10 or less where $S_A$ is a peak area value at 1162 $cm^{-1}$ and $S_B$ is a peak area value at 1533 $cm^{-1}$ obtained by infrared microspectrometry, and the modified portion is a region that extends 100 μm in a contact portion thickness inward direction from the contact portion on a plane that lies at an equal distance from two surfaces constituting the contact portion.

<2> The cleaning blade set forth in <1>, wherein the (meth) acrylate compound has an alicyclic structure having 6 or more carbon atoms in a molecule and includes 2 to 6 functional groups.

<3> The cleaning blade set forth in <2> above, wherein the (meth)acrylate compound having an alicyclic structure having 6 or more carbon atoms in a molecule has a molecular weight of 500 or less.

<4> The cleaning blade set forth in one of <2> to <3> above, wherein the (meth)acrylate compound having an alicyclic structure having 6 or more carbon atoms in a molecule is at least one selected from a (meth)acrylate compound having a tricyclodecane structure and a (meth)acrylate compound having an adamantane structure.

<5> The cleaning blade set forth in <4> above, wherein the (meth)acrylate compound having a tricyclodecane structure is at least one selected from tricyclodecane dimethanol diacrylate and tricyclodecane dimethanol dimethacrylate.

<6> The cleaning blade set forth in <4> above, wherein the (meth)acrylate compound having an adamantane structure is at least one selected from 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

<7> The cleaning blade set forth in <1> above, wherein the (meth)acrylate compound has a pentaerythritol tri(meth) acrylate structure including 3 to 6 functional groups.

<8> The cleaning blade set forth in any one of <1> to <6> above, wherein the ultraviolet curable composition further contains a (meth)acrylate compound having a pentaerythritol tri(meth)acrylate structure that includes 3 to 6 functional groups.

<9> The cleaning blade set forth in any one of <1> to <8> above, wherein the elastic member is a multilayered body formed by integrating two or more types of rubber having different JIS-A hardnesses.

<10> An image forming apparatus including:

an image carrier:

charging means for charging the image carrier;

exposing means for exposing the charged image carrier to form an electrostatic latent image;

developing means for developing the electrostatic latent image with a toner to form a visible image;

transferring means for transferring the visible image onto a recording medium;

fixing means for fixing the visible image transferred onto the recording medium; and cleaning means for removing the toner remaining on the image carrier, wherein the cleaning means is the cleaning blade set forth in any one of <1> to <9> above.

<11> A process cartridge including:

an image carrier; and cleaning means for removing a toner remaining on the image carrier, wherein the cleaning means is the cleaning blade set forth in any one of <1> to <9> above.

Numerous additional modifications and variations are possible in light of the above teachings. It is therefore to be understood that within the scope of the appended claims, the disclosure of the present invention may be practiced otherwise than as specifically described herein.

What is claimed is:

1. A cleaning blade comprising:

an elastic member configured to come into contact with a surface of a member to be cleaned and remove residual matter adhering to the surface of the member to be cleaned, the elastic member satisfying requirements a and b below:

a. The elastic member has a contact portion configured to come into contact with the surface of the member to be cleaned and the contact portion includes a modified layer that contains a cured product of an ultraviolet curable composition containing a (meth)acrylate compound; and b. A value obtained by normalizing a peak area ratio $S_A/S_B$ of a modified portion with a peak area ratio $S_A'/S_B'$ of a portion outside the modified layer is 1.5 or more and 10 or less where $S_A$ is a peak area value at 1162 $cm^{-1}$ and $S_B$ is a peak area value at 1533 $cm^{-1}$ obtained by infrared microspectrometry, and the modified portion is a region that extends 100 μm in a contact portion thickness inward direction from the contact portion on a plane that lies at an equal distance from two surfaces constituting the contact portion.

2. The cleaning blade according to claim 1, wherein the (meth)acrylate compound has an alicyclic structure having 6 or more carbon atoms in a molecule and includes 2 to 6 functional groups.

3. The cleaning blade according to claim 2, wherein the (meth)acrylate compound having an alicyclic structure having 6 or more carbon atoms in a molecule has a molecular weight of 500 or less.

4. The cleaning blade according to claim 2, wherein the (meth)acrylate compound having an alicyclic structure having 6 or more carbon atoms in a molecule is at least one selected from a (meth)acrylate compound having a tricyclodecane structure and a (meth)acrylate compound having an adamantane structure.

5. The cleaning blade according to claim 4, wherein the (meth)acrylate compound having a tricyclodecane structure is at least one selected from tricyclodecane dimethanol diacrylate and tricyclodecane dimethanol d methacrylate.

6. The cleaning blade according to claim 4, wherein the (meth)acrylate compound having an adamantane structure is at least one selected from 1,3-adamantane dimethanol diacrylate, 1,3-adamantane dimethanol dimethacrylate, 1,3,5-adamantane trimethanol triacrylate, and 1,3,5-adamantane trimethanol trimethacrylate.

7. The cleaning blade according to claim 1, wherein the (meth)acrylate compound has a pentaerythritol tri(meth) acrylate structure including 3 to 6 functional groups.

8. The cleaning blade according to a claim 1, wherein the ultraviolet curable composition further contains a (meth) acrylate compound having a pentaerythritol tri(meth)acrylate structure that includes 3 to 6 functional groups.

9. The cleaning blade according to claim 1, wherein the elastic member is a multilayered body formed by integrating two or more types of rubber having different JIS-A hardnesses.

10. An image forming apparatus comprising;

an image carrier;

charging means for charging the image carrier;

exposing means for exposing the charged image carrier to form an electrostatic latent image;

developing means for developing the electrostatic latent image with a toner to form a visible image;

transferring means for transferring the visible image onto a recording medium;

fixing means for fixing the visible image transferred onto the recording medium; and cleaning means for removing the toner remaining on the image carrier, wherein the cleaning means is the cleaning blade according to claim 1.

11. A process cartridge comprising:

an image carrier; and cleaning means for removing a toner remaining on the image carrier, wherein the cleaning means is the cleaning blade according to claim 1.

* * * * *